US006883423B2

(12) United States Patent
Yamamoto et al.

(10) Patent No.: US 6,883,423 B2
(45) Date of Patent: Apr. 26, 2005

(54) ASSEMBLY AND METHOD FOR CUSTOMIZED APPLICATION OF INDEX TABS TO INDEXING MATERIAL

(75) Inventors: Norman Yamamoto, Yorba Linda, CA (US); Jay K. Sato, Aliso Viejo, CA (US)

(73) Assignee: Avery Dennison Corporation, Pasadena, CA (US)

( * ) Notice: Subject to any disclaimer, the term of this patent is extended or adjusted under 35 U.S.C. 154(b) by 29 days.

(21) Appl. No.: 10/066,303

(22) Filed: Jan. 30, 2002

(65) Prior Publication Data

US 2002/0129522 A1 Sep. 19, 2002

Related U.S. Application Data

(60) Provisional application No. 60/308,209, filed on Jul. 27, 2001, and provisional application No. 60/277,141, filed on Mar. 19, 2001.

(51) Int. Cl.[7] ..... B42F 21/00

(52) U.S. Cl. ..... 101/35; 40/641; 283/36; 283/37; 283/41

(58) Field of Search ..... 101/35; 40/641; 283/36, 37, 38, 39, 40, 41, 42, 43

(56) References Cited

U.S. PATENT DOCUMENTS 3,191,767 A * 6/1965 Glowiak ..... 206/223
3,205,597 A 9/1965 Stern
3,221,430 A 12/1965 Cunningham
3,691,662 A 9/1972 Cunningham
3,805,426 A * 4/1974 Cunningham ..... 40/641
4,053,057 A 10/1977 Snowden
4,137,658 A 2/1979 Wos
4,190,357 A * 2/1980 Kostiner ..... 355/74
4,355,824 A 10/1982 Weber et al.
4,369,582 A 1/1983 Pfeffer (Continued)

FOREIGN PATENT DOCUMENTS

GB 2150500 A * 7/1985 ..... B42F/21/04

*Primary Examiner*—Daniel J. Colilla
(74) *Attorney, Agent, or Firm*—Squire, Sanders & Dempsey, LLP

(57) ABSTRACT

A customized application of index tabs to dividers and other types of indexing material includes a releasably attachable alignment tool. The alignment tool includes a plurality of indicia printed thereon for guiding the placement of a desired number of index tabs. The indicia indicate by positioning of both numerals and lines where an index tab is to be placed on an indexing material, depending on the number of index tabs that are to be placed. The alignment tool may also be positioned on a sheet and removable from the sheet to align index tabs on different documents. Multiple alignment tools may also be positioned on a sheet and removable to align index tabs on documents of different sizes.

104 Claims, 18 Drawing Sheets

U.S. PATENT DOCUMENTS 4,460,634 A * 7/1984 Hasegawa ..... 428/124
4,520,055 A 5/1985 Jeter
4,784,508 A 11/1988 Shannon
5,012,590 A 5/1991 Wagner et al.
5,182,152 A * 1/1993 Ericson ..... 428/40.9
5,215,396 A 6/1993 Rogers
5,335,421 A 8/1994 Jones, Jr.
5,503,487 A 4/1996 Ong
5,531,028 A 7/1996 Flippen
5,666,737 A 9/1997 Ryan, III
5,771,598 A 6/1998 Lassberg
5,792,297 A 8/1998 Hunter et al.
5,924,812 A 7/1999 Goldman
5,947,525 A 9/1999 Pollman
5,966,852 A * 10/1999 Drzewiecki ..... 40/360
6,013,154 A 1/2000 Thomas-Cote
6,086,281 A 7/2000 Covey
6,089,777 A 7/2000 Wong
6,099,189 A * 8/2000 Owen et al. ..... 402/79
6,115,932 A 9/2000 Fedora
6,158,135 A 12/2000 Rank
6,237,243 B1 5/2001 Cook
6,244,628 B1 * 6/2001 Muller ..... 283/38
6,332,285 B1 * 12/2001 Aaldenberg et al. ..... 40/641
6,364,366 B1 4/2002 Schwartz
2001/0003872 A1 * 6/2001 Pederson ..... 33/758

* cited by examiner

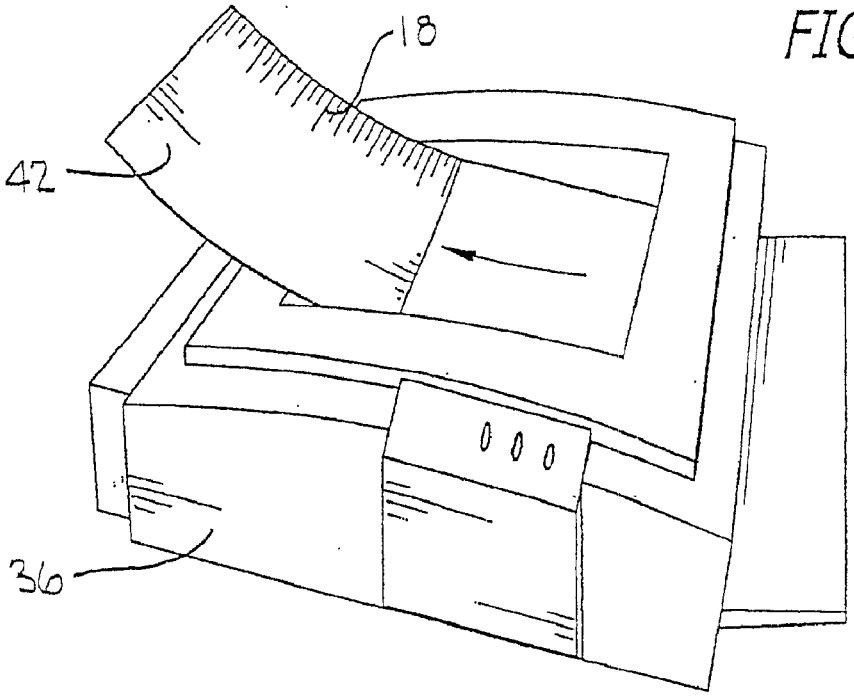
FIG. 21
FIG. 22
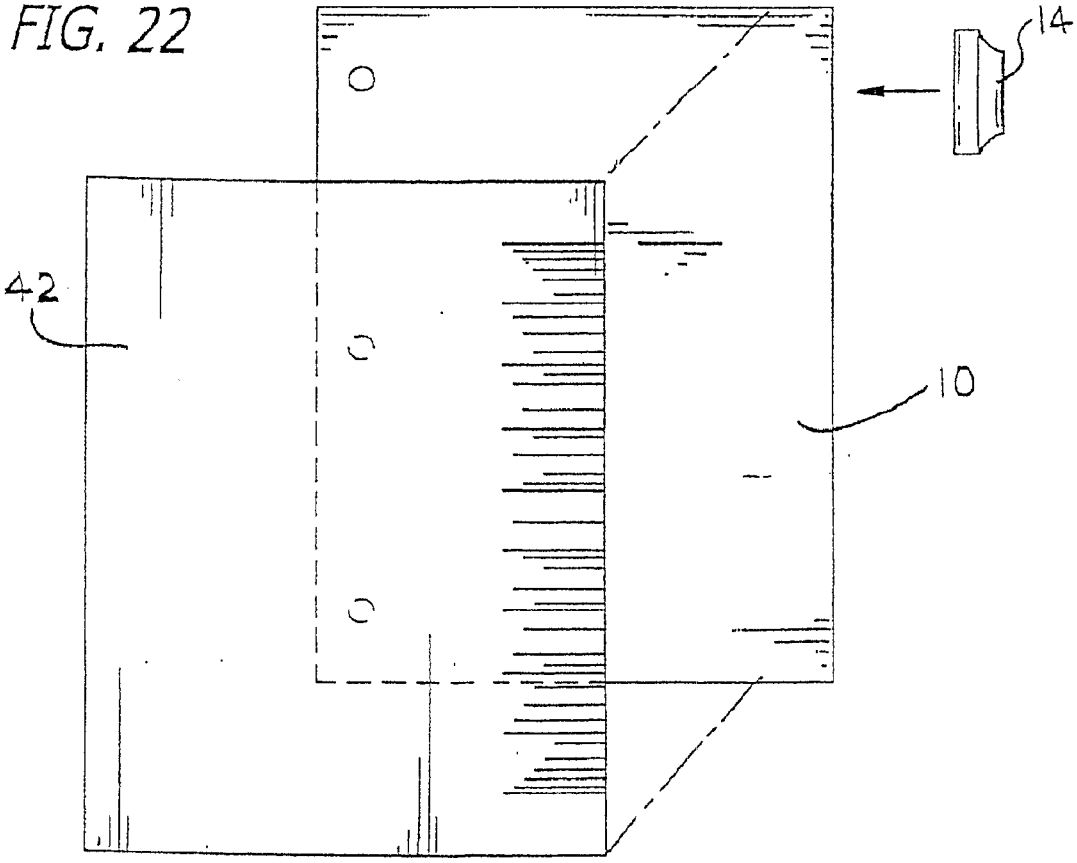

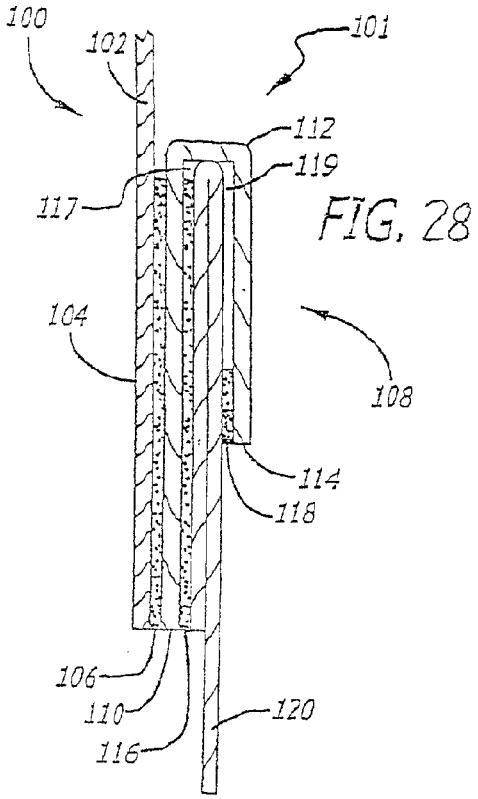
FIG. 28
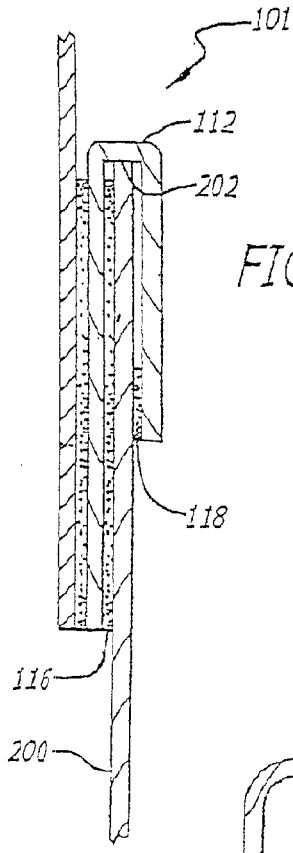
FIG. 29
FIG. 30
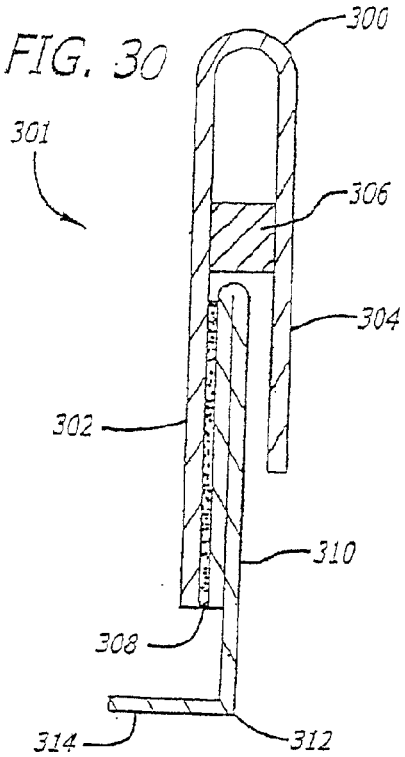
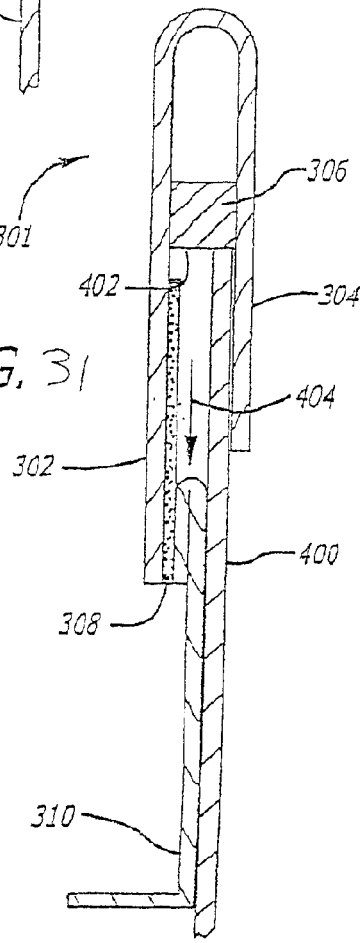
FIG. 31

FIG. 38
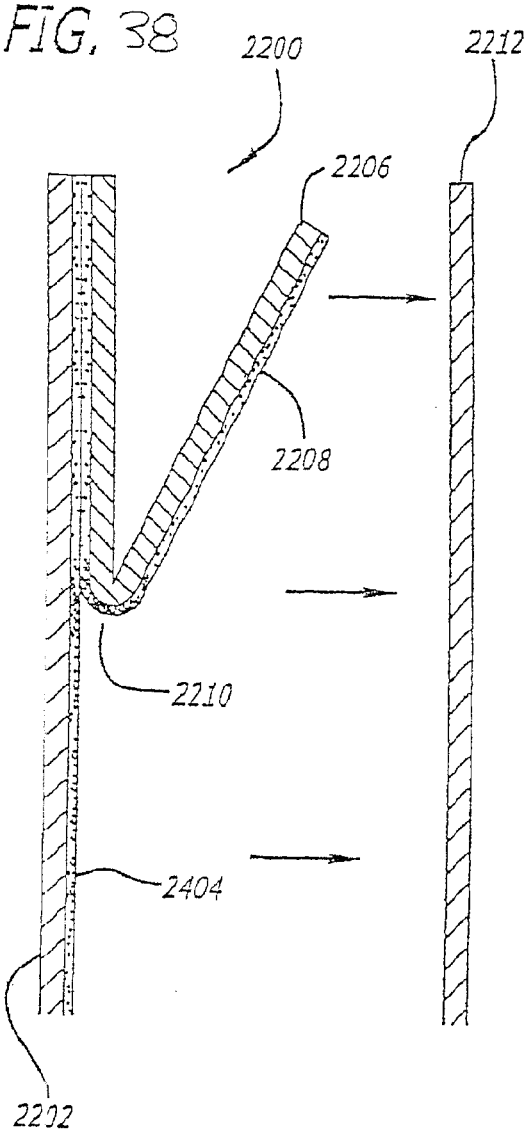
FIG. 40
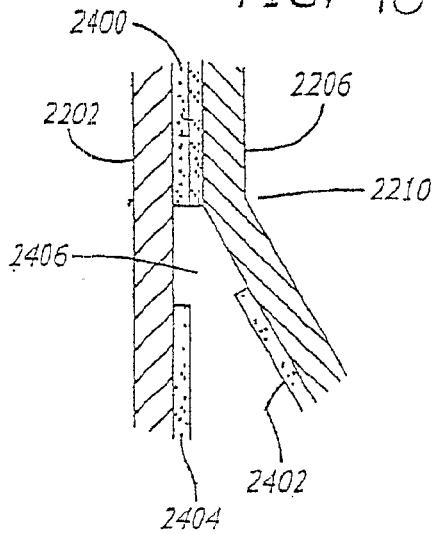
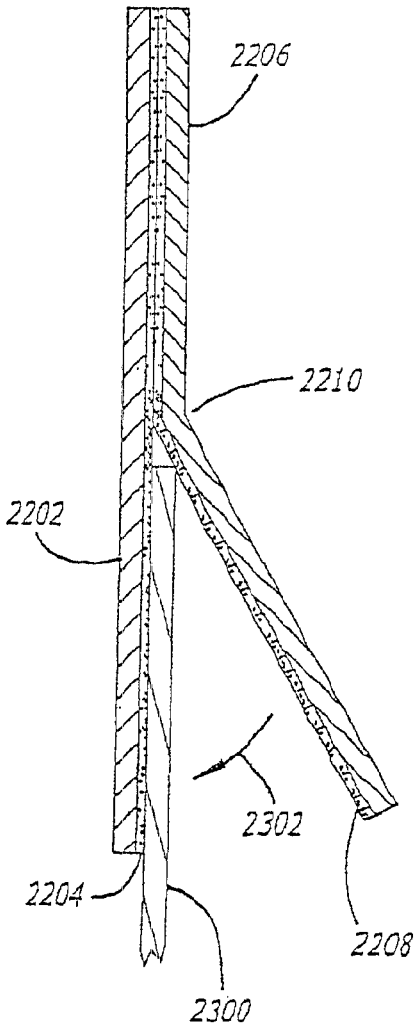
FIG. 39

ASSEMBLY AND METHOD FOR CUSTOMIZED APPLICATION OF INDEX TABS TO INDEXING MATERIAL

CROSS-REFERENCE TO RELATED APPLICATIONS

The contents of this application are related to and claim the filing date benefit of provisional application Ser. No. 60/308,209, filed on Jul. 27, 2001, and provisional application having Ser. No. 60/277,141, filed on Mar. 19, 2001. The contents of these related provisional applications are incorporated herein by reference.

BACKGROUND OF THE INVENTION

1. Field of the Invention

The present invention relates to the application of index tabs. Specifically, the invention provides an assembly and method of customizing the application of index tabs to dividers and other kinds of indexing documents.

2. General Background and State of the Art

Many examples of the application of index tabs to dividers and other types of indexing material are known. U.S. Pat. No. 3,590,511, for example, discloses an indexing system for attachment to filing folders, index cards, planning boards or other similar filing/organizing systems. The patent includes an elongated, rectangular strip having an adhesive portion for attaching the strip to an edge of a folder, index card or board. The indexing system also includes index tabs with ends which are bent towards each other so that the tabs are slidably retained on the strip. The tabs are therefore movable along the strip so that they can be positioned by a user.

Another patent, U.S. Pat. No. 3,303,080, discloses a system for accurately positioning index tabs along the free side of a page with respect to the top and bottom and with respect to each other on additional pages. The system has a strip and a set of index tabs. The strip having the index tabs is applied to the page onto which the index tabs are to appear, in the same position with respect to the top and bottom as is desired for the index tabs to appear on other pages. The top and bottom of the strip are folded over the top and bottom of the page, respectively. An index tab is then removed from the strip, and using the next index tab as a guide, is affixed to one face of the page. The index tab is then folded in half to complete the placement of the index tab, with one half affixed to one face of the page and the other half affixed to the opposing face.

Another patent, U.S. Pat. No. 5,503,487, discloses a system of placing index tabs in which a separator page is provided having a series of slots positioned on one edge. The system includes index tabs which have a top part and a bottom part, the top part including a receptacle for a label, and the bottom part including a pair of ears for placement into the slots. An index tab is placed on the separator sheet by inserting the ears into the slots, thereby providing a secure method of holding an index tab in place. Index tabs can therefore be placed in slots in different positions on multiple separator pages along the edge of each separator page as desired by the user.

In one variation of the '487 patent, a marginal strip is placed over an edge of the separator page. The marginal strip includes at least one layer of adhesive that is used to apply the strip to the edge of the separator page. The marginal strip includes a plurality of slots placed in parallel relation to each other. In another variation, the marginal strip also has a plurality of slots, as well as curved edges which are used to slide the marginal strip over the edge of the separator page. In both variations, index tabs are applied to the separator pages by inserting the ears into the slots and positioning the index tabs as desired on the separator pages.

SUMMARY OF THE INVENTION

The patents discussed above do not disclose an assembly and system for customized placement of index tabs on indexing material in which printed indicia on a removable tool are used to align index tabs and guide the adherence of those tabs to indexing material. Accordingly, it is an object of the present invention to provide a customized assembly and method of applying index tabs. It is another object of the invention to provide a releasably attachable alignment tool that is capable of being removed from an indexing material when no longer needed. It is a further object of the invention to provide a guide for the placement of a desired number of index tabs on an indexing material, which may include a set of documents such as dividers or index cards. It is yet another object of the present invention to provide printed indicia to guide the placement of index tabs on the indexing material.

The present invention provides an assembly and method for the customized application of index tabs. The invention includes an indexing material or indexing document(s), which may be in the form of a divider or a set of dividers, an index card or a set of index cards, or any other indexing material to which index tabs may be applied. Each divider or index card includes a removably attachable alignment tool. Each tool includes indicia for identifying the placement of index tabs. The indicia may be in the form of horizontal and/or vertical lines and numbers (or other symbols) indicating placement positions for the index tabs. Using the present invention, therefore, users can customize the application of a desired number of index tabs provided with a set of dividers.

The present invention also provides a method of applying index tabs to the indexing material, in which an index tab is aligned along an edge of an indexing material according to indicia provided on the releasably attachable alignment tool. The releasably attachable alignment tool may be removed from the indexing material, which may include a divider, index card or any other type of document to which index tabs may be applied. Additional index tabs may also be applied to additional indexing material that comprises the set of dividers or index cards or other documents, with the releasably attachable alignment tool being removed from each indexing material once an index tab has been placed thereon.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 21 is a view of a printer (or copier) having a sheet exiting the printer with indicia printed on the sheet;

FIG. 22 is a view of a sheet having indicia printed thereon being placed over an indexing material;

FIG. 28 is a cross-sectional view illustrating a first exemplary index tab embodiment;

FIG. 29 is a cross-sectional view illustrating the first exemplary index tab embodiment of the present invention aligned with and attached to an edge of a mounting sheet;

FIG. 30 is a cross-sectional view illustrating a second exemplary index tab embodiment;

FIG. 31 is a cross-sectional view illustrating the second exemplary index tab embodiment of the present invention aligned with and attached to an edge of a mounting sheet;

FIG. 38 illustrates another alternative exemplary layered tab area;

FIG. 39 illustrates use of the alternative exemplary layered tab area illustrated in FIG. 38; and FIG. 40 illustrates an alternative construction of the alternative exemplary layered tab area illustrated in FIG. 38.

DETAILED DESCRIPTION OF PREFERRED EMBODIMENTS OF THE INVENTION

In the following description of the present invention reference is made to the accompanying drawings which form a part thereof, and in which is shown, by way of illustration, exemplary embodiments illustrating the principles of the present invention and how it may be practiced. It is to be understood that other embodiments may be utilized to practice the present invention and structural and functional changes may be made thereto without departing from the scope of the present invention.

Figure 2:
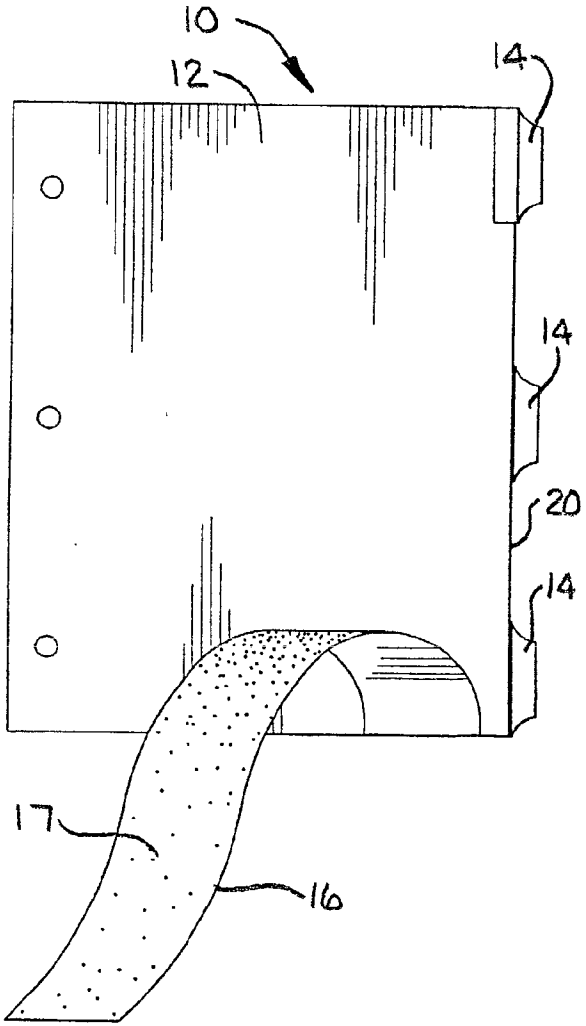
FIG. 2 is a perspective view of a divider having at least one index tab and an alignment tool of the present invention removably attached thereto.
Figure 1:
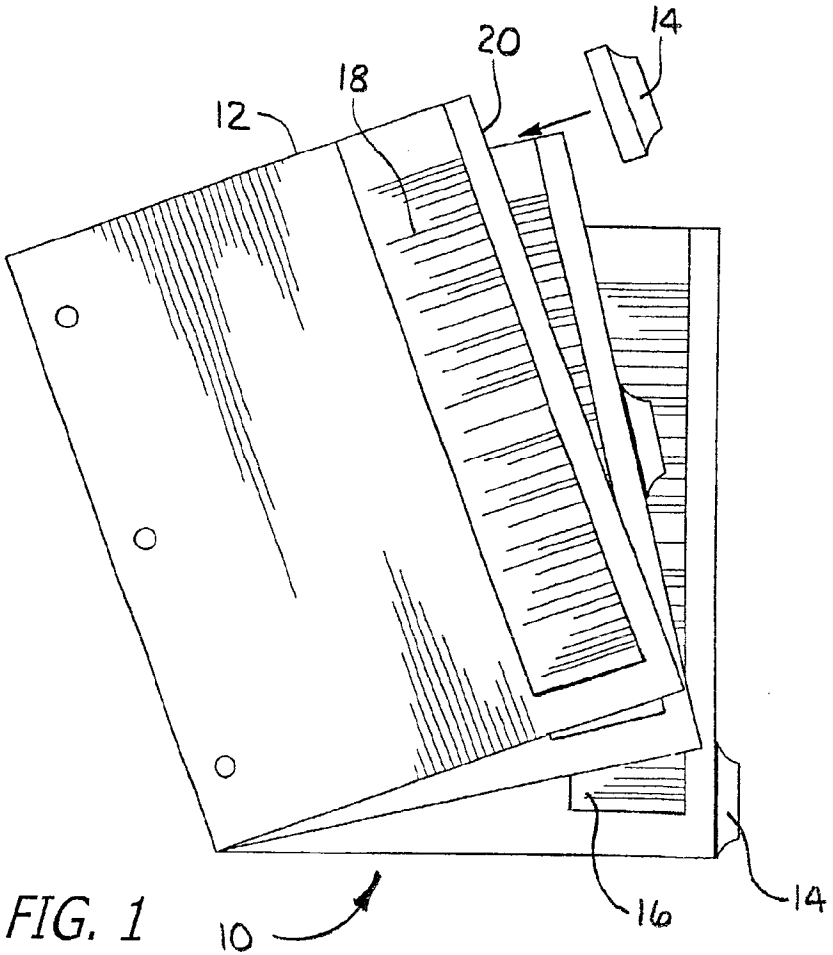
FIG. 1 is a perspective view of a set of dividers each having at least one index tab and an alignment tool of the present invention attached thereto.

FIG. 1 is a perspective view of an indexing material 10. The indexing material 10 as shown in FIG. 1 is a set of dividers. Each divider 12 in the set of dividers includes at least one index tab 14 positioned thereon. Additionally, each divider 12 in the set of dividers includes a removably attachable alignment tool 16 attached near an edge 20 of the divider 12 on which it is placed. Each releasably attachable alignment tool 16 includes a plurality of indicia 18 for guiding the placement of the index tab 14 on each divider 12. FIG. 1 shows the releasably attachable alignment tool 16 entirely attached to a divider 12. The releasably attachable alignment tool 16 is positioned at a point on the divider 12 that is near an edge 20 of the divider 12 to provide a gap between the end of the releasably attachable alignment tool 16 and the edge 20 to allow for the placement of an index tab 14. FIG. 2 is an overhead view of a set of dividers. The first divider 12 includes an index tab 14 and a releasably attachable alignment tool 16. In FIG. 2, the releasably attachable alignment tool is shown partially peeled off of the divider 12.

Figure 3:
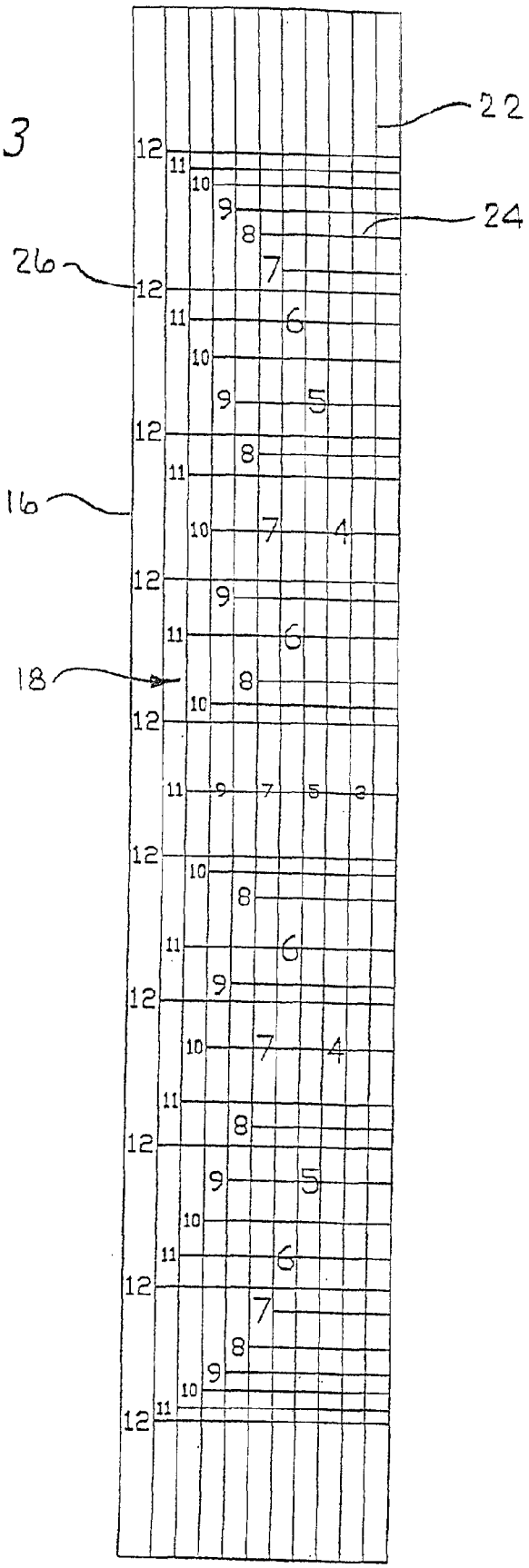
FIG. 3 is a close-up view of a removably attachable alignment tool of the present invention.

FIG. 3 is a close-up view of a releasably attachable alignment tool 16 having a plurality of indicia 18 printed thereon, such as with the tool of FIG. 1. The indicia 18 may include a plurality of vertical lines 22, a plurality of horizontal lines 24 and a plurality of numerals 26. The vertical lines 22, horizontal lines 24, and numerals 26 are printed or otherwise provided on the releasably attachable alignment tool 16 to guide the placement of a desired number of index tabs 14 on the indexing material 10. The numerals 26 correspond to the number of index tabs 14 to be used. For example, if a user wishes to place twelve index tabs, one on each of twelve dividers, the user would first place a first index tab 14 on a first divider 12 aligned with a top of the divider. Then, at the first instance of the numeral twelve and its corresponding horizontal line, the user would align the top of a second index tab on a second divider 12. At the third divider 12, the user would align the top of an index tab 14 at the second instance of the numeral twelve and its corresponding horizontal line on that particular divider 12, and so forth continuing with the next successive instance of the numeral twelve until reaching the bottom of the releasably attachable alignment tool 16 on the last divider.

The same method of application occurs regardless of the desired number of index tabs the user of the present invention wishes to utilize. Therefore, if the user wishes to utilize eight index tabs, the first index tab 14 is aligned along a top of the first divider 12. At the next divider 12, the user aligns the next index tab 14 at the first instance of the numeral eight and its corresponding horizontal line. Following that, at the third divider 12, the user would locate the next instance of the numeral eight and its corresponding horizontal line and align an index tab 14 along that horizontal line along that divider 12, and so on for the rest of the dividers 12 in that particular set.

The indicia 18 may be positioned on the tool 16 depending upon many factors, such as the length of the indexing material, the length of the index tab, and the number of index tabs to be placed on the indexing material. For example, positioning of indicia may be calculated by subtracting a length of the index tab base, a length between the first tab and the top edge of an indexing material, and a length between the last tab and the bottom edge of an indexing material from a length of the indexing material to be used. This figure is then divided by the number of index tabs to be used less one. The resulting figure equals the uniform spacing of indicia on the tool 16. Therefore, the tool 16 can be designed specifically for a particular indexing material size and index tab size. In another embodiment, a tool 16 may include multiple sets of indicia for different sizes of indexing material and index tabs.

The indicia 18 on the releasably attachable alignment tool 16 may be color-coded to further guide the application of a desired number of index tabs 14 on indexing material 10. For example, each instance of the numeral "12" and its corresponding horizontal line may be one particular color, while each instance of the numeral "10" and its corresponding horizontal line may be an additional color. Likewise, each numeral and its corresponding horizontal line may be a different color to guide the placement of index tabs according to that particular numeral. In another embodiment, different sections of the releasably attachable alignment tool 16 may be color-coded to provide an easier way of guiding the placement of index tabs on the alignment tool 16. For example, the area of the alignment tool 16 including and underneath the numeral twelve and its corresponding horizontal line may be coded one particular color, while the area under numeral eleven and its corresponding horizontal line may be color-coded a different color, and so forth for each different numeral and its corresponding horizontal line.

Figure 4:
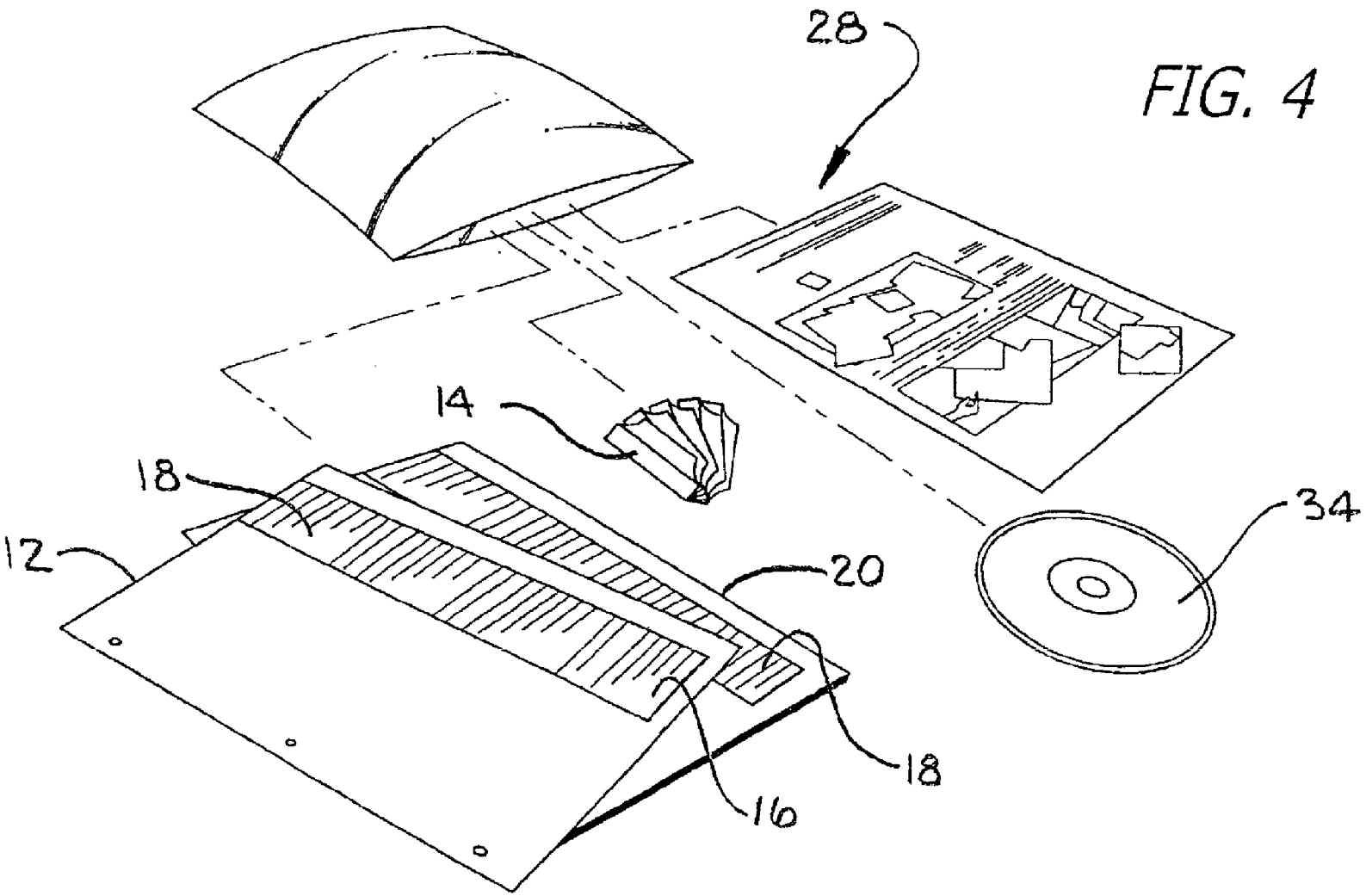
FIG. 4 is an exploded perspective view of a package having a set of index tabs and a set of dividers and a releasably attachable alignment tool of the present invention on each divider.

FIG. 4 is a perspective view of a retail package 28 having a set of dividers and a set of index tabs 14. Each divider in the set of dividers includes one releasably attachable alignment tool 16 releasably attached thereto. In one embodiment, the package 28 includes a specific number of dividers 12 and a specific number of corresponding index tabs 14. A customer purchasing the package 28 would remove the set of indexing material 10 including the dividers 12 from a bag 29 and align the set of index tabs 14 on the dividers 12 according to his or her preference and guided by the releasably attachable alignment tool 16 already positioned on each divider 12. When finished placing the set of index tabs 14 on the dividers 12, the user has the option of removing the releasably attachable alignment tool 16 from each divider 12, such as by peeling it off as illustrated in FIG. 2. The package 28 may also include a device 34 having software for printing customized indicia on the divider 12 and also on the tool 16. The device 34 may be a CD-ROM, a floppy diskette, or other type of storage device capable of having software stored thereon.

In one embodiment, the present invention also provides for releasably attachable alignment tools, index tabs, and indexing document such as dividers to be packaged and sold separately. For example, if additional index tabs are needed, they can be obtained as a separately packaged item for use with a releasably attachable alignment tool 16. Similarly, if additional tools are needed, they can be obtained as a separately packaged item. Additional indexing material, such as index tabs and dividers for use with the releasably attachable alignment tool 16, can also be packaged separately and obtained as needed.

The software for printing customized indicia may provide several different options for a user wishing to print indicia. The software may guide a user through the process of inputting variables in the indicia spacing formula and print the resulting indicia on a tool 16, an indexing material such as a divider 12, or any other paper or material that can be used to align index tabs to an indexing material. For example, a user may print desired indicia on a strip of paper and then re-use the strip for multiple pages of indexing material. In this example, the strip of paper may be mounted on a mounting material and then applied to indexing material without having to repeatedly attach and then release the strip to the indexing material itself. In another example, a user may print desired indicia on a standard sheet of 8.5"×11.0" paper having multiple tools 16 placed thereon, with each tool having printed indicia as directed by a user. In yet another example, the user may print a tool with indicia on a standard sheet of 8.5"×11.0" or other commonly-used size of paper. The sheet may be blank, pre-printed with the outline of a tool or tools, or pre-scored with weakened lines outlining a tool or tools that are intended to be removed by a user along those weakened lines. A user may also have multiple tools of varying sizes printed on the same sheet with the software described above.

The software for designing and printing the indicia 18 may also be downloadable and/or accessible from the Internet as an alternative to being included on a device 34 within package 28. Therefore, a user may purchase the indexing material, index tabs and tool(s) 16 and then utilize the software from the Internet to design his or her own customized indicia for printing on the tool(s).

Figure 11:
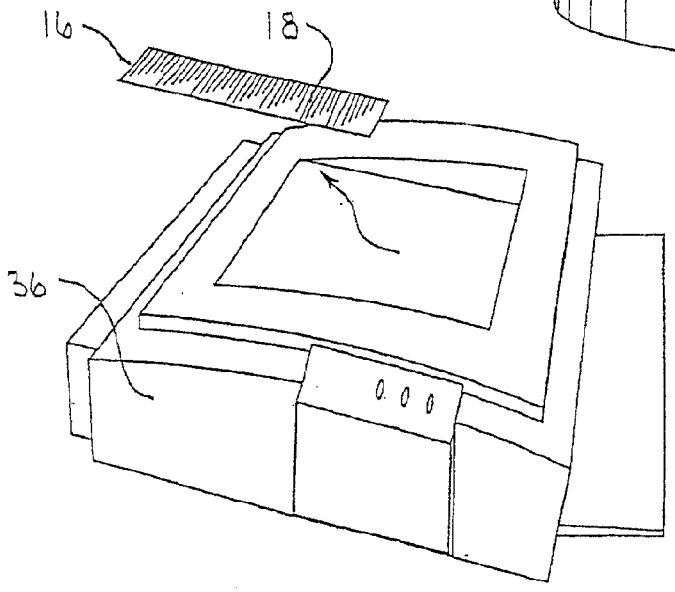
FIG. 11 is a perspective view of a printer (or copier) having a releasably attachable alignment tool exiting the printer with indicia printed thereon.

FIG. 11 is a perspective view of a printer or copier 36 and a releasably attachable alignment tool 16 having indicia 18 printed by the printer. The printer 36 may also print the indicia 18 directly on an indexing material, or, alternatively, on several releasably attachable alignment tools 16 positioned on an indexing material. The indexing material in this example may be a standard 8.5 inch by eleven inch sheet or other dimensions as would be apparent to those skilled in the art.

The printer or copier 36 may also be used to print any kind of indicia or objects on indexing material or on a releasably attachable alignment tool. For example, if a customer wishes to place corporate indicia or logos on a divider, he or she may use the printer or copier 36 to print on the divider prior to the placement of index tabs on the divider using the releasably attachable alignment tool 16.

Each releasably attachable alignment tool 16 has an adhesive substance 17 applied to one side thereof. In a preferred embodiment, the adhesive substance 17 is a Clean-Tac I ultra-removable adhesive. However, other types of adhesives may be used. Also in a preferred embodiment, the adhesive coat weight is 1.0 to 1.2 lbs./ream. The paper used for manufacturing the releasably attachable alignment tool 16 is, in a preferred embodiment, CAN N/S (known by the trade name Canary Note Sticks) Georgia Pacific bond (twenty lbs.), and is an uncoated, canary yellow material. However, other types of bond and other colors may suitably be used to manufacture the releasably attachable alignment tool without departing from the essence of the invention. Also in a preferred embodiment, the caliper of the paper used to manufacture the releasably attachable alignment tool is between 3.6 and 3.9 mils. The width of the adhesive strip applied to a side of the releasably attachable alignment tool is approximately ½ inch, with a variance of 1/32 inch. The width of the entire releasably attachable alignment tool 16 is 1 7/16 inch, with a variance of 1/32 inch. There is an ungummed portion along each edge of the releasably attachable alignment tool 16 with the gummed, adhesive strip in the middle of the two ungummed portions. On one side of the adhesive strip, an ungummed portion is ⅞ inch wide, and on the opposing side of the adhesive strip, there is 1/16 inch wide ungummed portion. The peel strength of the adhesive strip when peeled from paper of a similar construction is approximately 20–79 g/in as measured by the Tag and Label Manufacturer's Institute 90° peel test at a peel rate of twelve in./minute. The adhesive and paper used in the production of the releasably attachable alignment tool are supplied by Moore Business Forms, located at 1200 Lakeside Drive, Bannockburn, Ill., 60015.

The tool 16 has approximately a slightly shorter length than the indexing document to which it is to be applied. The length of the tool 16 may also vary depending on the type of index tab used. For example, where the indexing document is a divider that is eleven inches long and where two inch index tabs are being used, the length of the tool 16 may be nine inches. In another example, where indexing document is a divider that is eleven inches long and where one inch index tabs are being used, the length of the tool 16 may be ten inches. Because indexing documents may have different lengths, such as the difference between standard 8½ inch by eleven inch sheets and European A4 size sheets, the length of the tool 16 that is releasably attached thereto may vary depending on these different lengths. The length of the tool may also be the same as the length of the indexing document to which it is applied.

The present invention provides that, in one embodiment, the dividers 12 will come pre-packaged with a releasably attachable alignment tool 16 already affixed thereto as shown in FIG. 4. However, in another embodiment, the package may be sold with a set of releasably attachable alignment tools included separately within the same package 28 such as that shown in FIG. 5. A user could therefore apply each releasably attachable alignment tool to a divider 12 as he or she sees fit. Each releasably attachable alignment tool 16 is also reusable such that when removed from a divider 12 it can be affixed to another indexing material for reuse. In the embodiment where the releasably attachable alignment tools are included as separate items not already releasably attached to the dividers 12, each alignment tool 16 includes a backing material that must be separated (e.g., peeled off) from the adhesive substance on a side of the tool before the tool 16 can be applied to a divider 12.

In still another embodiment, the package may be sold with a pack of releasably attachable alignment tools 16 stacked on top of each other. In this embodiment, each tool includes an adhesive portion for releasably attaching to an indexing material when removed from the pack of tools. In yet another embodiment, the package may be sold with one releasably attachable alignment tool 16 provided separately from the indexing material. In this embodiment, the tool 16 is pre-mounted on a mounting material that is transferable to multiple dividers or other indexing material. The mounting material is therefore releasably attachable to the indexing material onto which it is placed.

Figure 6:
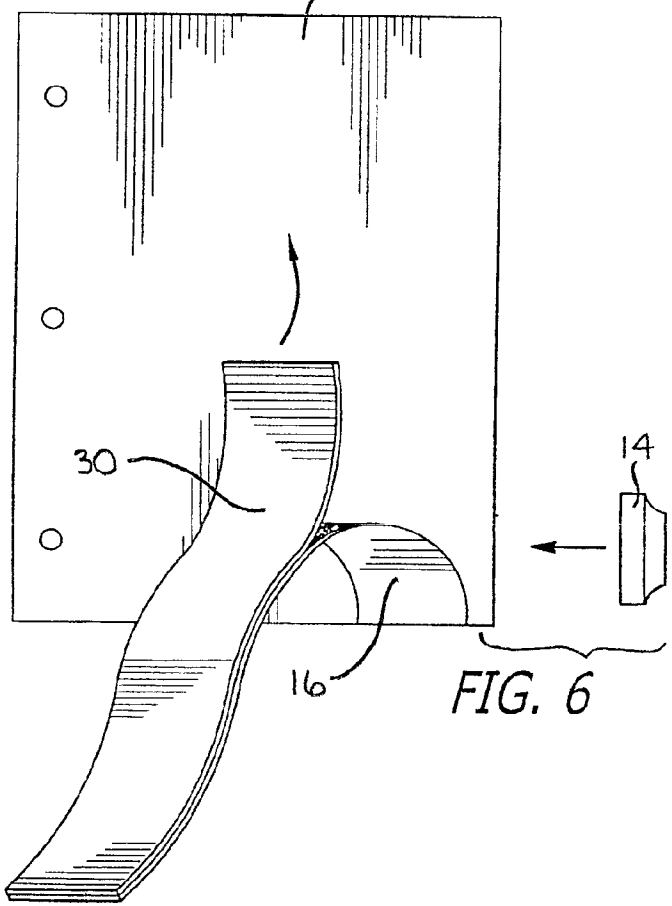
FIG. 6 is a perspective view of a releasably attachable alignment tool having a backing material shown being applied to a sheet.
Figure 5:
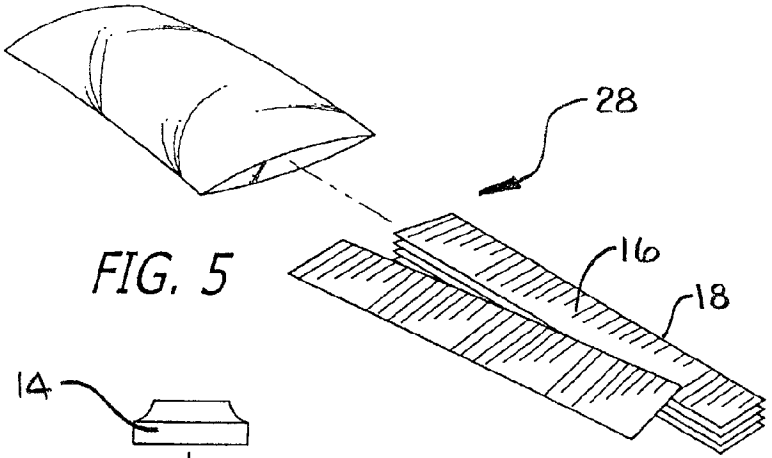
FIG. 5 is a perspective view of a package including only a set of releasably attachable alignment tools of the invention.

FIG. 5 shows an additional embodiment in which a package 28 includes only a set of releasably attachable alignment tools 16. Each of the tools 16 in this embodiment include a backing material 30 attached to a back side of the tool 16. The backing material 30 protects the adhesive substance on the back side of the tool 16. FIG. 6 shows the application of a tool 16 having a backing material 30. Prior to application of the tool 16 to an indexing document, the backing material 30 is removed from the back side of the tool 16 to expose the adhesive substance. The tool 16 is then applied to the indexing document, which in FIG. 6 is a divider 12. Also in FIG. 6, an index tab 14 is also applicable to the divider 12.

Figure 7:
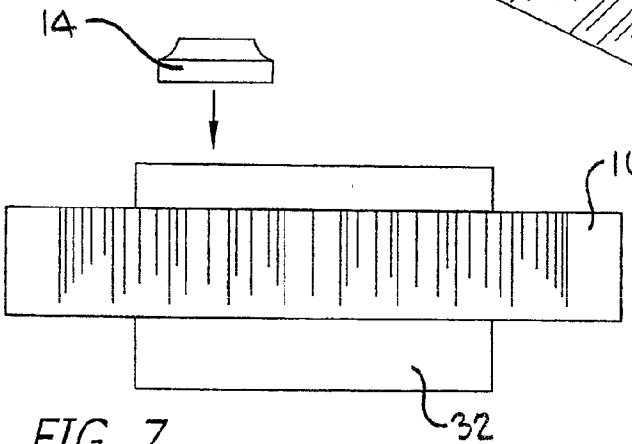
FIG. 7 is a front view of a releasably attachable alignment tool applied to an index card, where the tool is the same size as that applied to a divider with the ends adapted to be folded over the index card to fit the tool on the card.
Figure 8:
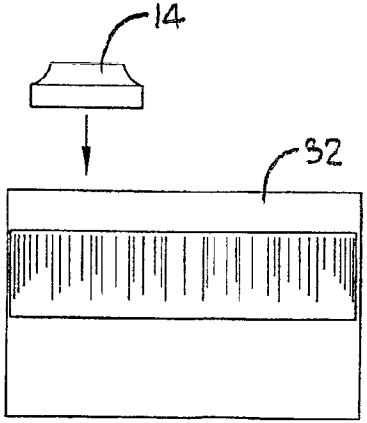
FIG. 8 is an additional front view of the releasably attachable alignment tool applied to an index card, in which the tool is sized to fit the length of the index card.

FIGS. 7 and 8 show additional embodiments of the present invention in which the tool 16 is applied to an index card 32. In FIG. 7, the tool 16 is the same size as that applied to a divider 12. In this embodiment, the ends of the tool 16 are folded over the index card 32 to fit the tool 16 on the card. In FIG. 8, the tool 16 is sized to fit the length of an index card 32. The tool 16 may therefore be customized to fit the particular indexing document to which it will be applied, such that different sizes of the tool 16 may be available to fit different types of indexing material.

Figure 9:
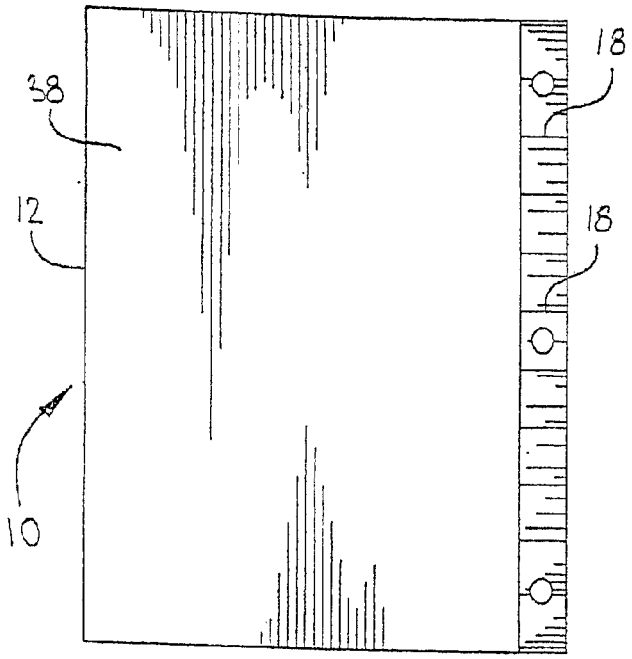
FIG. 9 is a plan view of an indexing material in which the divider includes indicia printed directly thereon along the binding edge thereof.
Figure 10:
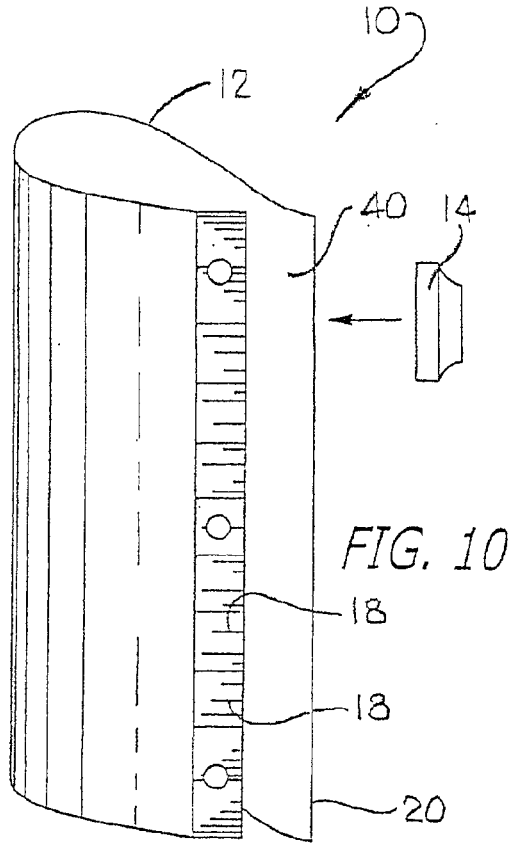
FIG. 10 is a view of the divider of FIG. 9 being rolled over such that the back side with the indicia printed thereon is even with the edge of a front side to which index tabs will be placed.

FIG. 9 is a view of an indexing material in which a divider 12 includes indicia 18 printed directly thereon. The indicia 18 are printed on a back side 38 of the divider 12, close to a series of holes in the divider 12 that allow for the divider 12 to be placed in a binder. FIG. 10 shows the divider 12 being rolled over such that the back side 38 with the indicia 18 printed thereon is even with the edge 20 on a front side 40 to which index tabs will be placed. The indicia 18 on the back side are therefore used to align the index tabs 14 on the indexing material. The indicia 18 on the divider 12 may be preprinted or, in an alternate embodiment, printed by a user in the printer 36 as desired.

Figure 12:
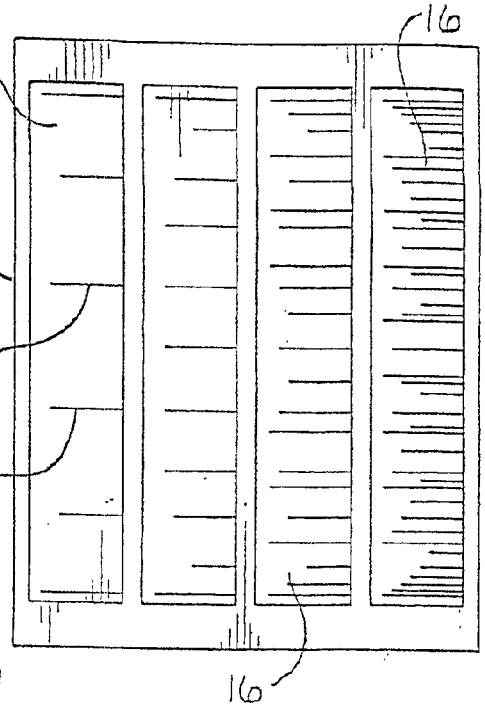
FIG. 12 is a view of sheet having a plurality of alignment tools positioned thereon.
Figure 14:
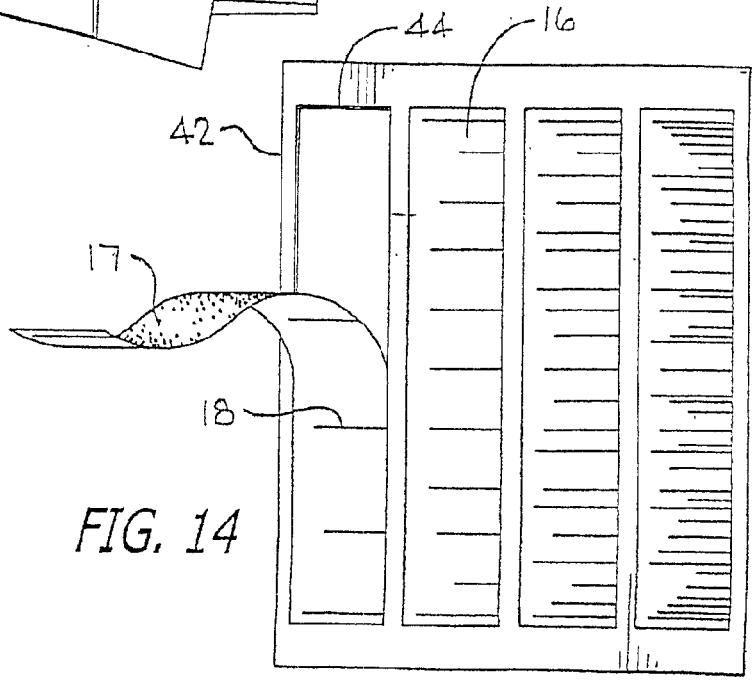
FIG. 14 is a view of a sheet having a plurality of alignment tools positioned thereon, with one tool being removed from said sheet.
Figure 15:
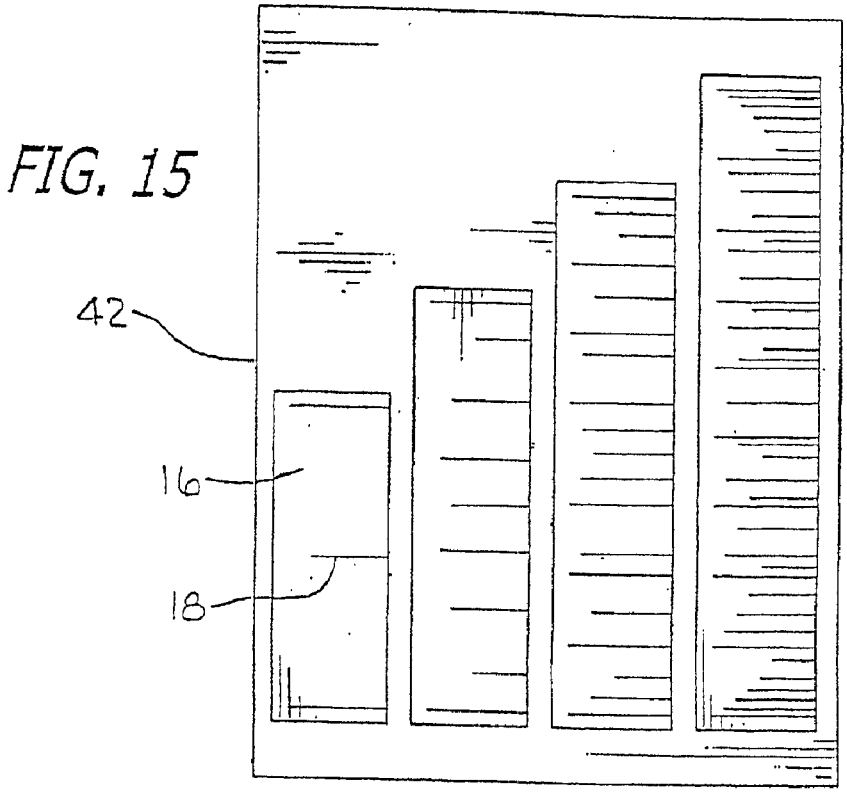
FIG. 15 is a view of sheet having a plurality of alignment tools positioned thereon, with the plurality of tools being of different sizes.

FIG. 12 is a view of a sheet 42 having a plurality of alignment tools 16 positioned thereon. The plurality of alignment tools 16 may be printed in the printer (or copier) 36 by a user using software provided in the device or downloaded from the Internet. The plurality of alignment tools 16 may be all of the same size as shown in FIG. 12, or they may be of varying sizes as shown in FIG. 15. FIG. 14 is a view of the sheet 42 having a plurality of alignment tools 16 positioned thereon, with one tool being removed from the sheet 42. In this embodiment, all of the tools 16 may be removable from the sheet 42. The tools 16 and indicia 18 may be either pre-printed or printed by the user within pre-scored or weakened lines 44 such that the tools 16 are easily removable by the user, or on blank releasably attachable alignment tools.

Figure 13:
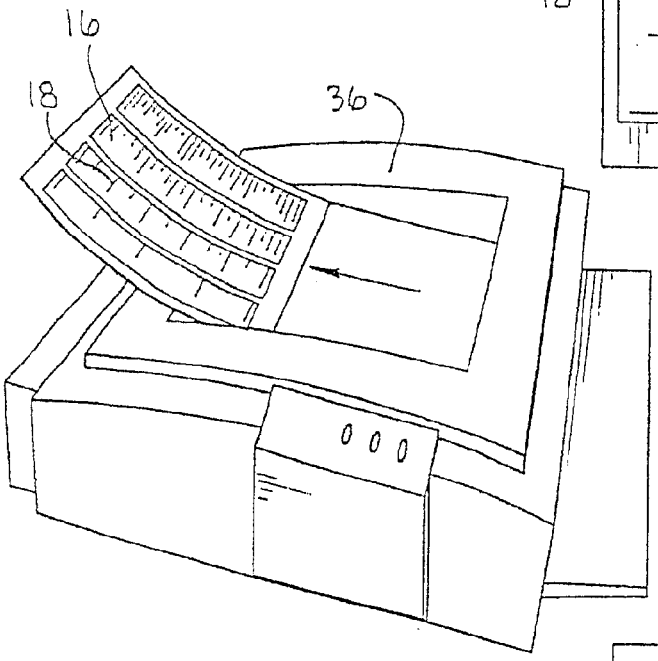
FIG. 13 is a perspective view of a printer (or copier) having a sheet with a plurality of releasably attachable alignment tools exiting the printer with indicia printed on the tools.
Figure 16:
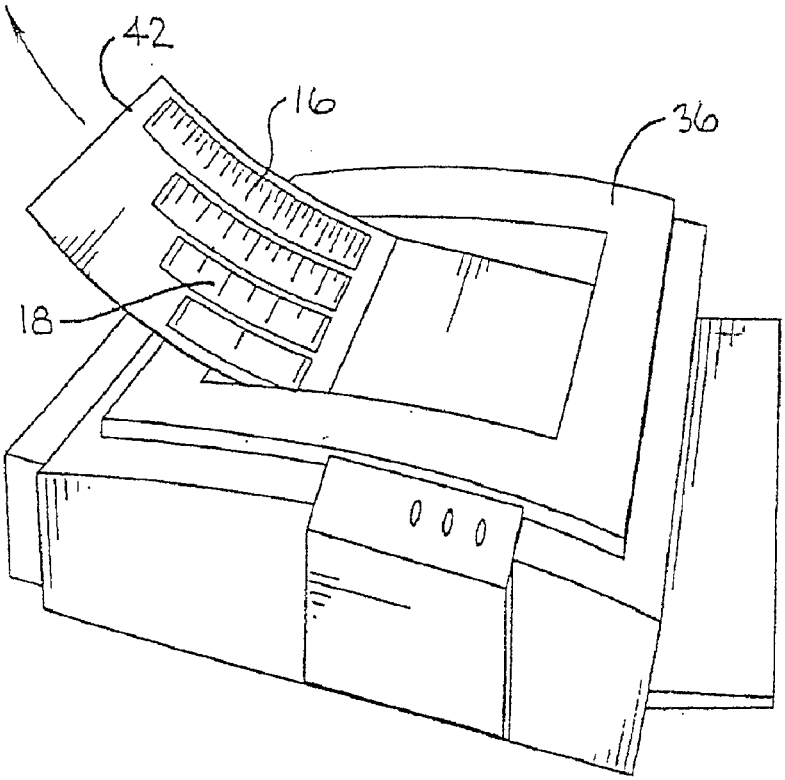
FIG. 16 is a perspective view of a printer (or copier) having a sheet with a plurality of releasably attachable alignment tools of varying size exiting the printer with indicia printed on the tools.

FIG. 13 is a perspective view of a printer (or copier) 36 having the sheet 42 with a plurality of releasably attachable alignment tools 16 exiting the printer or copier 36 with the indicia 18 printed on the tools. FIG. 16 is a perspective view of the printer (or copier) 36 having the sheet 42 with a plurality of releasably attachable alignment tools 16 of varying size exiting the printer (or copier) 36 with the indicia 18 printed on the tools 16. In both FIG. 13 and FIG. 16, the tools 16 may be removable by the user either by peeling the tool from the sheet 42 or by removing the tools 16 from a series of pre-scored or weakened lines 44.

Figure 17:
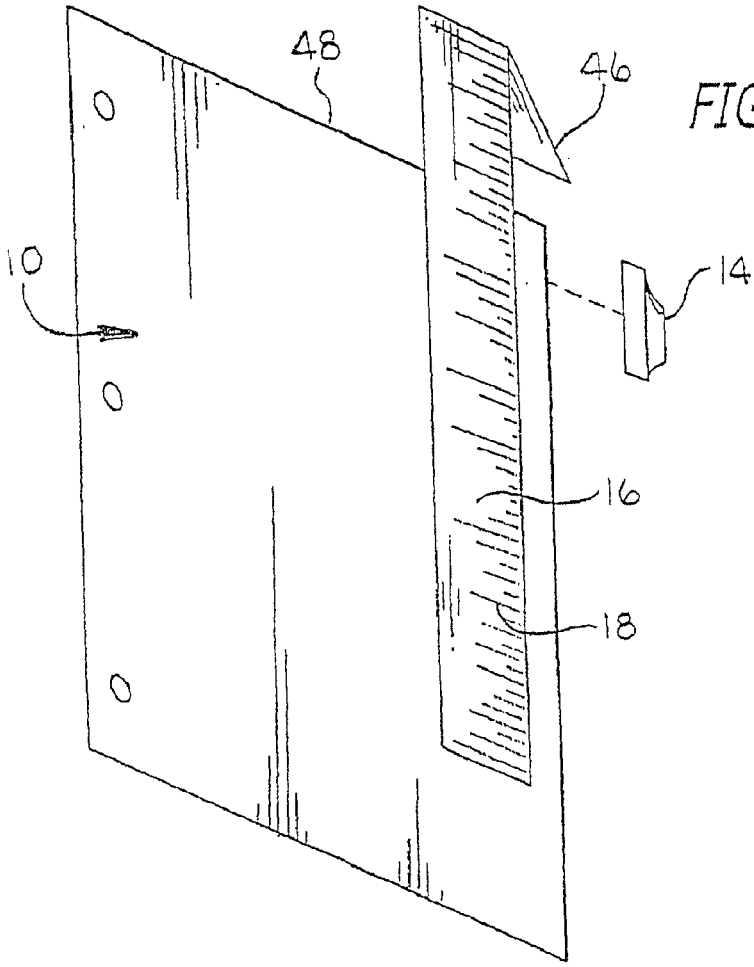
FIG. 17 is a view of an indexing material and a releasably attachable alignment tool having a top portion folder over a top edge of the indexing material.
Figure 18:
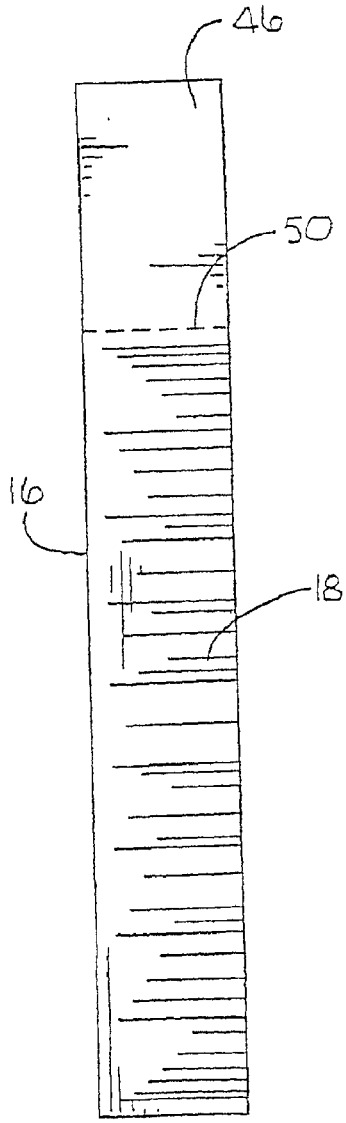
FIG. 18 is a view of the alignment tool of FIG. 17 having a weakened line at which the top portion folds over.
Figure 19:
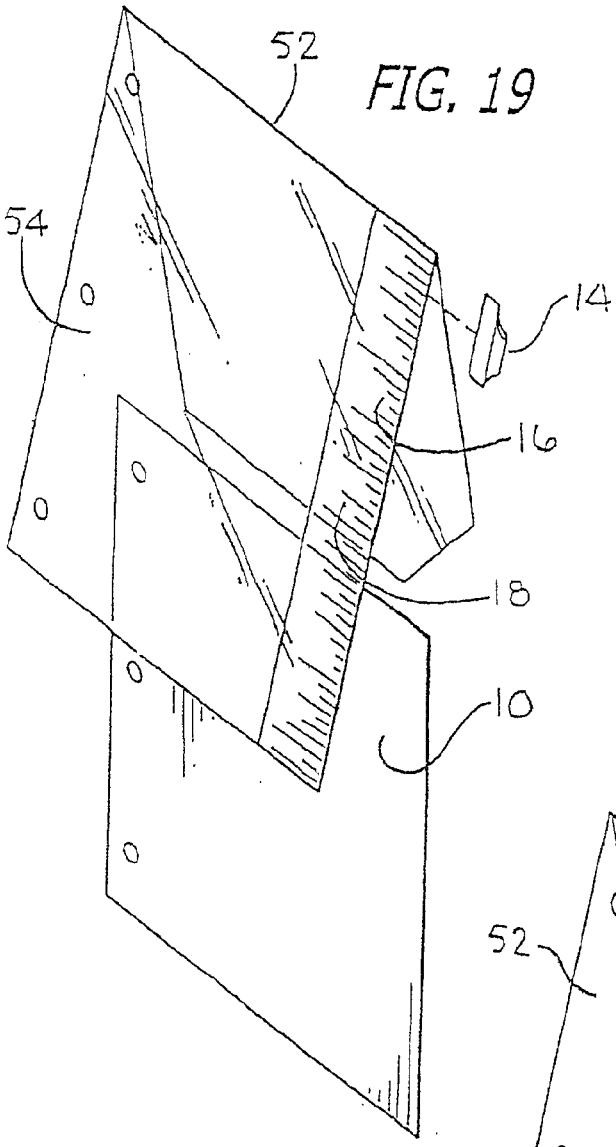
FIG. 19 is a perspective view of a flapped device having an alignment tool positioned thereon and indexing material being inserted into said flapped device.

FIG. 17 is a view of an indexing material and a releasably attachable alignment tool 16 having a top portion 46 folded over a top edge 48 of the indexing material. The top portion 46 of the tool 16 may be formed along a weakened line 50 at the top of the tool 16. The weakened line 50 and top portion 46 are shown in FIG. 18. FIG. 19 is a view of a flapped device 52 having an alignment tool 16 positioned thereon and indexing material being inserted into the flapped device 52. In one embodiment, the alignment tool 16 is releasably attached to the front face 54 of the flapped device 52 using an adhesive substance on the back of the tool 16. In another embodiment, the alignment tool 16 and indicia 18 are printed directly on the front face 54 of the flapped device 54. In yet another embodiment, the alignment tool 16 includes the top portion 46 for positioning over a top edge of the flapped device 52 to releasably attach the alignment tool 16 to the flapped device 52. This is similar to using the embodiments of FIG. 17 and FIG. 18 without a flapped device.

Figure 20:
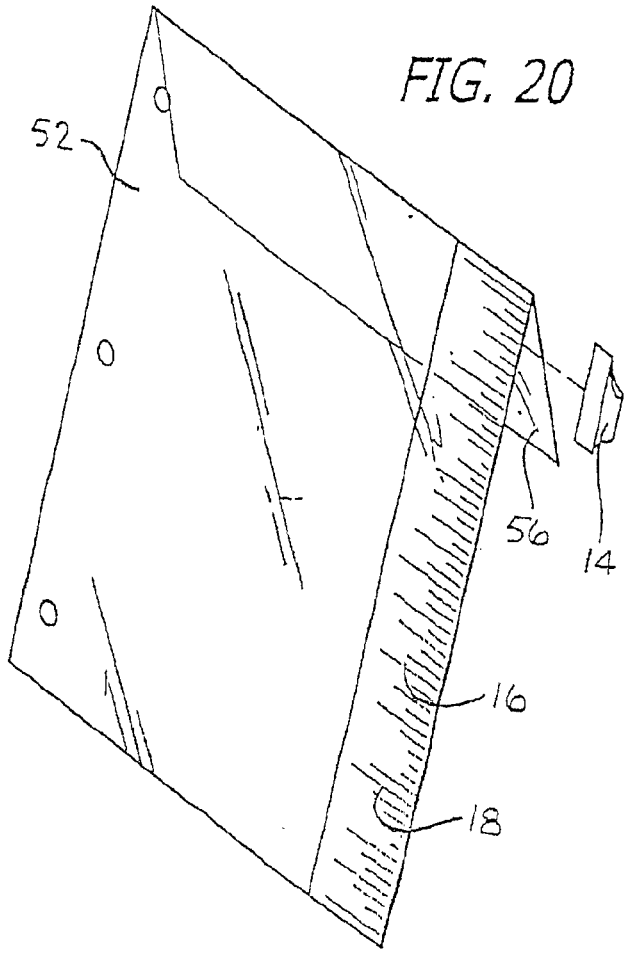
FIG. 20 is a perspective view of a flapped device having an alignment tool positioned thereon, the flapped device having a rear portion for placing over the top of an indexing material.

FIG. 20 is a view of the flapped device 52 having an alignment tool 16 positioned thereon. The flapped device 52 has a rear portion 56 for placing over the top of an indexing material 10. The alignment tool 16, positioned on the front face 54 of the flapped device 52 in any of the embodiments described in the preceding paragraph, is used to align the placement of index tabs 14 on the indexing material 10 placed within the flapped device 52 under the rear portion 56. The indexing material 10 is removable and the flapped device 52 can be reused to align the placement of index tabs 14 on multiple sheets of indexing material 10.

In another embodiment of the present invention, FIG. 21 is a view of a printer (or copier) 36 having a sheet 42 exiting the printer (or copier) 36 with indicia 18 printed on the sheet 42. The sheet 42 of FIG. 21 is used to place over an indexing material 10. This is shown in FIG. 22. The sheet 42 with the indicia 18 printed thereon is also used to align the placement of index tabs 14 on the indexing material 10. The sheet 42 of this embodiment can be reused with multiple indexing material 10 to align the placement of index tabs 14 on the indexing material 10.

Figure 23:
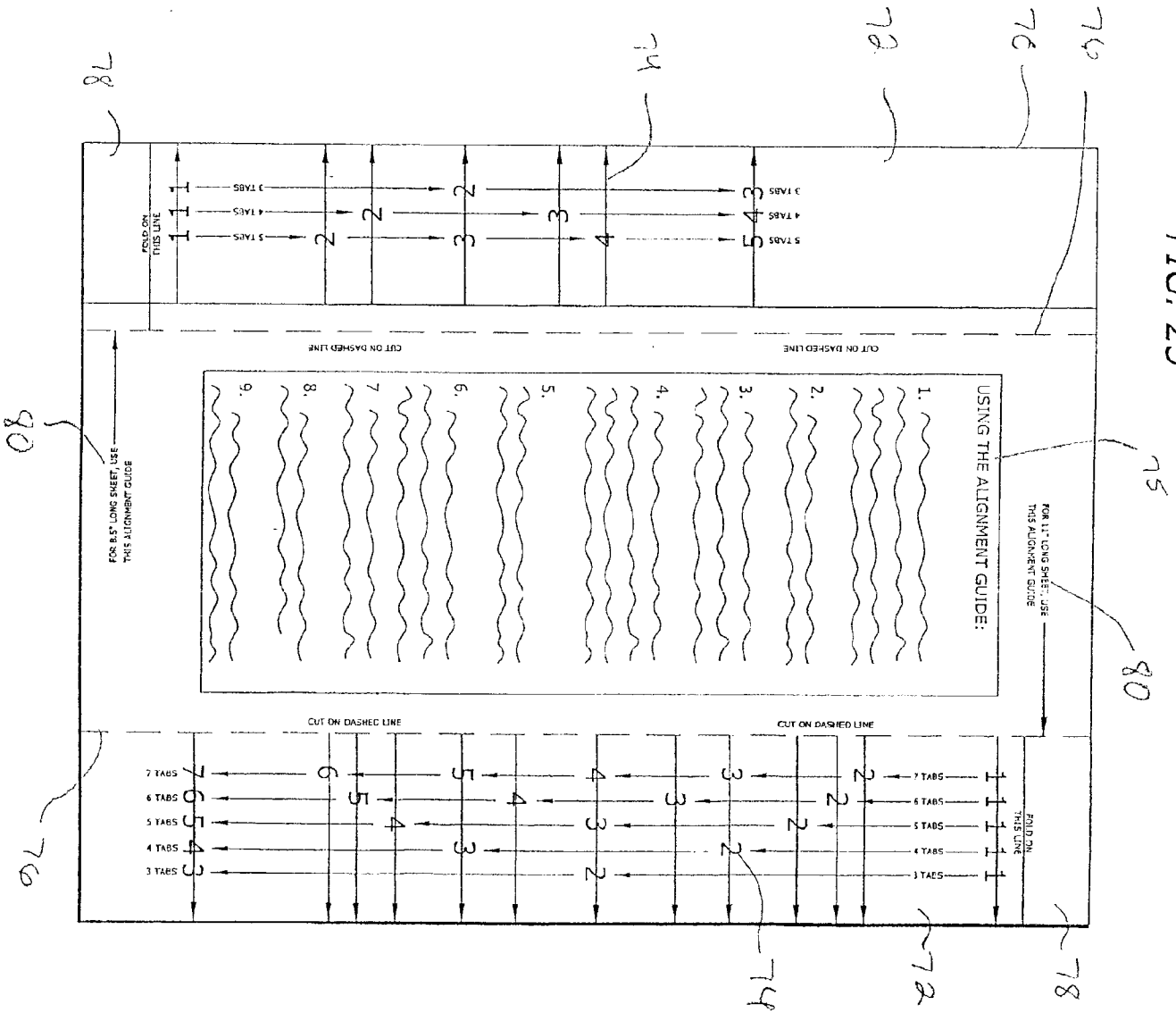
FIG. 23 is a view of sheet having a pair of alignment tools positioned thereon and having indicia on each identifying specific index tab alignment positions.
Figure 25:
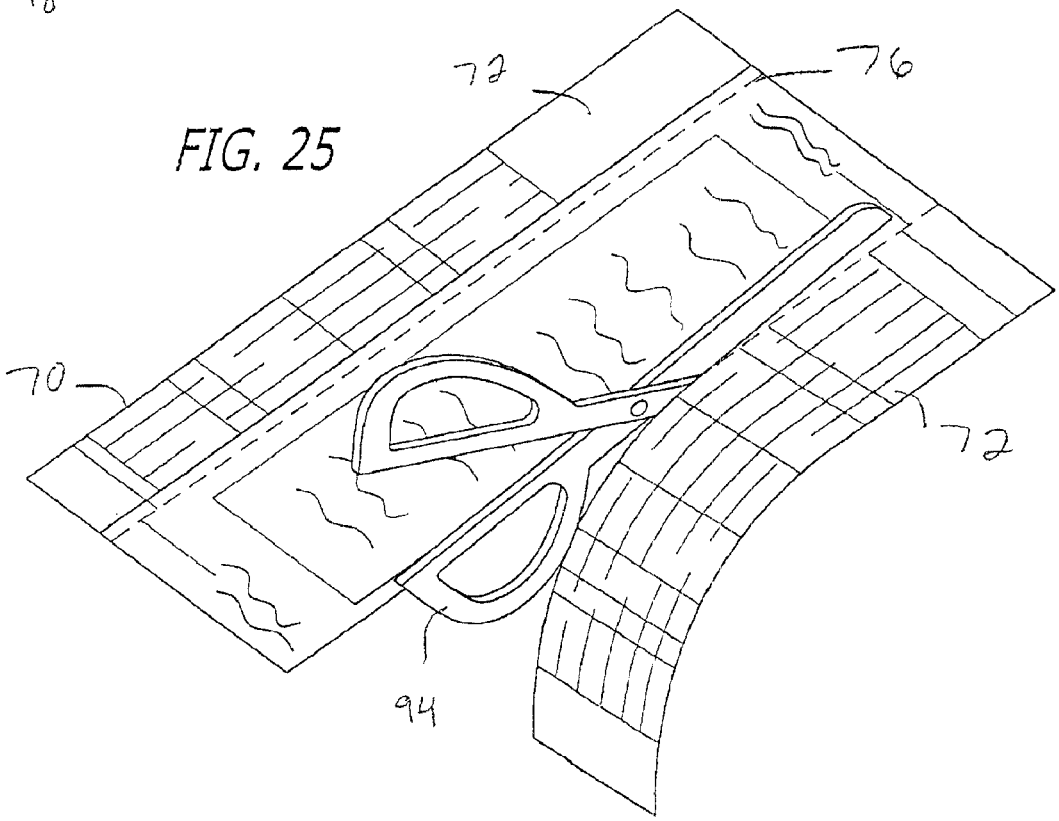
FIG. 25 is a view of sheet having a pair of alignment tools positioned thereon, with one tool being removed from the sheet along a line of separation.

In another embodiment of the present invention, alignment tools are positioned on a sheet for removal from the sheet along separation lines to be releasably attachable to indexing documents. FIG. 23 is a view of a sheet 70 having a pair of alignment tools 72 positioned thereon and having indicia 74 on each identifying specific index tab alignment positions. In this embodiment, the alignment tools 72 are pre-positioned on the sheet 70 having separation lines 76 guiding the removal of the tools 72 from the sheet 70. The tools 72 can be cut from the sheet 70 using scissors 94, knives, or other similar cutting devices. FIG. 25 is a view of the sheet 70 having the pair of alignment tools 72 positioned thereon, with one tool being removed from the sheet along a line of separation 76. The tools 72 can also separated by tearing along the separation lines 76. In this embodiment, the separation lines 76 may be in the form of pre-scored lines of weakness to allow easy separation from the sheet.

Figure 24:
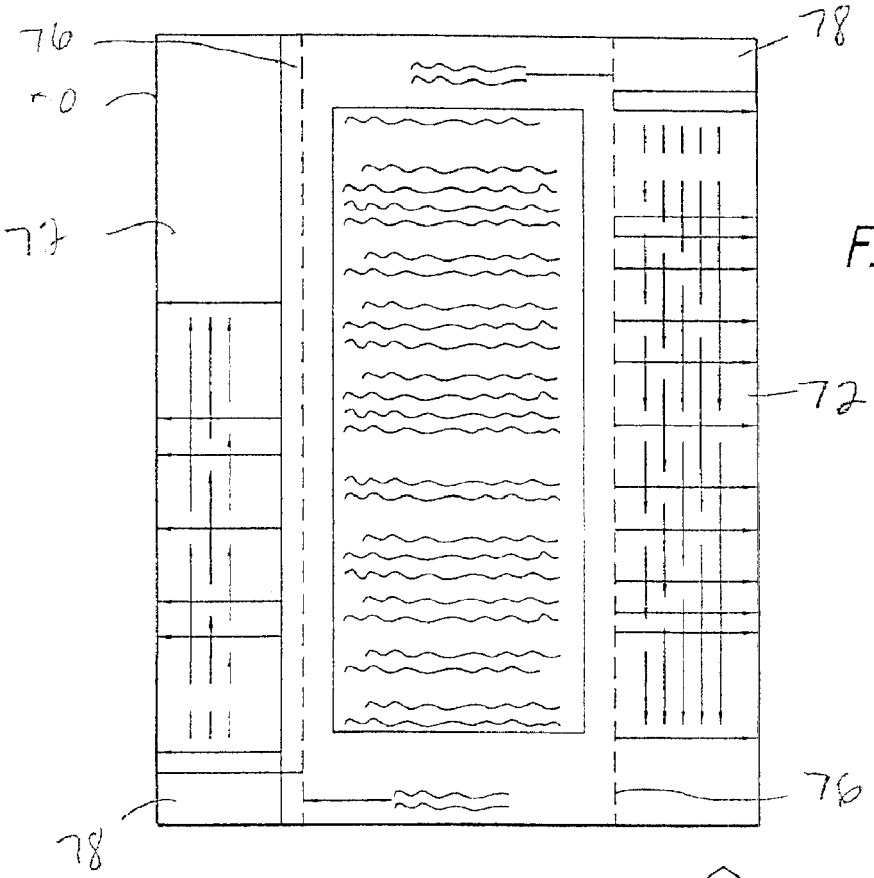
FIG. 24 is a view of the sheet of FIG. 23 showing a pair of alignment tools and indicia generally placed on both the tools and the sheet itself.

The alignment tools 72 of this embodiment include indicia identifying multiple index tab alignment positions. The indicia on each tool may be different to accommodate placement of the tool on different sizes of indexing material. For example, one of the tools on the sheet may be for alignment and placing index tabs on sheets of 11 inches in length. Another tool on the sheet may be for use on sheets of 8.5 inches in length. Each sheet 70 having alignment tools 72 may also include separate indicia 75 conveying instructions for using the tools. FIG. 24 is a view of the sheet 70 of FIG. 23 showing a pair of alignment tools 72 and indicia generally placed on both the tools and the sheet itself. Each of the alignment tools may also include a section 78 to be folded over the edge of an indexing document. Indicia 80 on each tool identifying the section to be folded may also be included on the tools. Using this fold-over aspect, an alignment tool 72 is easily attachable to and removable from an indexing document to guide the placement of index tabs.

Figure 26:
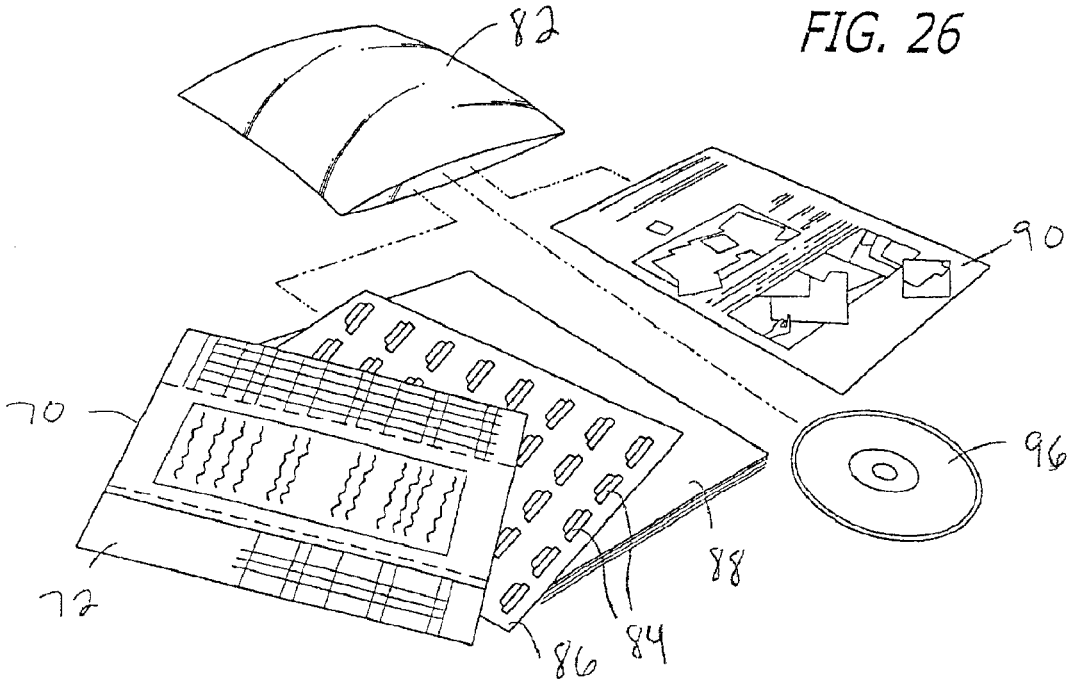
FIG. 26 is a perspective view of a package including a set of index tabs positioned on a sheet, a set of indexing documents, a sheet having a plurality of alignment tools thereon, a compact disc, and accompanying documentation.
Figure 27:
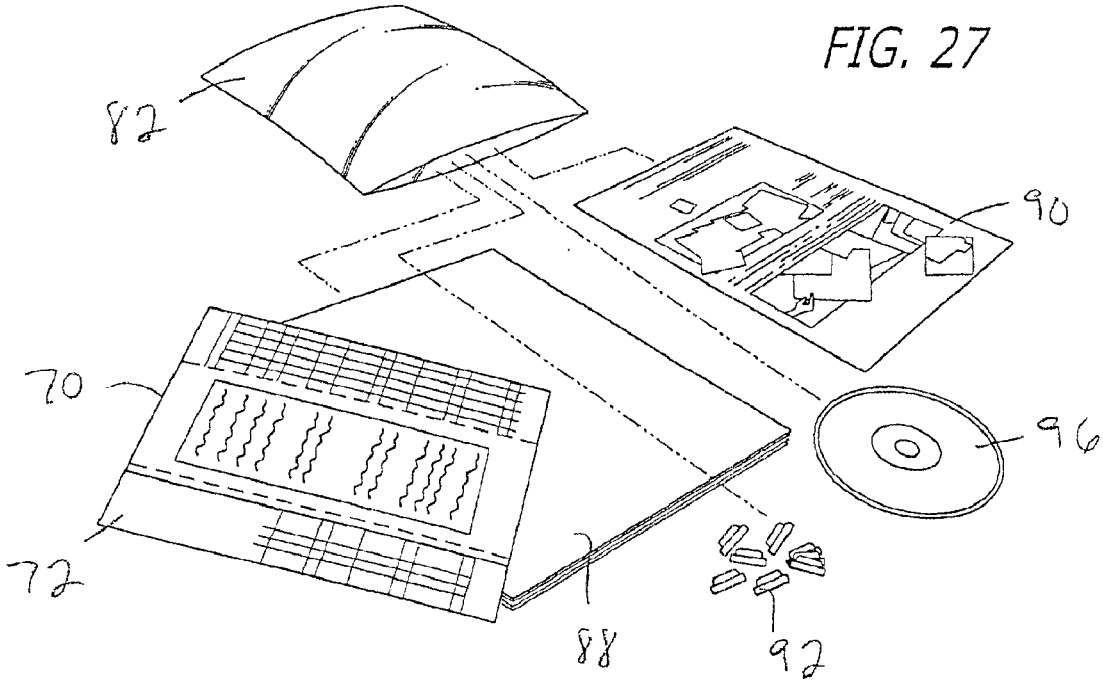
FIG. 27 a perspective view of a package including a set of loose index tabs, a set of indexing documents, a sheet having a plurality of alignment tools thereon, a compact disc, and accompanying documentation.

FIG. 26 is a perspective view of a package 82 including a set of index tabs 84 positioned on a sheet 86, a set of indexing documents 88, a sheet 70 having a plurality of alignment tools 72 thereon, a compact disc 96, and accompanying documentation 90. In this embodiment, a sheet 70 having alignment tools for different sizes of indexing material is included in a package 82 having index tabs 84 positioned on a backing sheet 86. The alignment tools 72 are removable from the sheet 70 and releasably attachable to indexing material, which may also be provided in the same package, for aligning and placing the index tabs. FIG. 27 a perspective view of a package 82 including a set of loose index tabs 92, a set of indexing documents 88, a sheet 70 having a plurality of alignment tools 72 thereon, a compact disc 96, and accompanying documentation 90. In this embodiment, the index tabs 92 are loosely contained in the package 82 having the plurality of alignment tools 72 positioned on the sheet 70. The tools 72 are removable from the sheet 70 and releasably attachable to indexing material to align and place the loose index tabs 92 on the indexing material 88.

The present invention contemplates that any type of index tab commonly known in the art can be used with the releasably attachable alignment tool 16 of the present invention. In a preferred embodiment, an index tab has an aligning portion connected to a tab portion for aligning the tab accurately, and easily, with an edge of an indexing material. The aligning portion engages the edge of the indexing material for alignment, yet requires no user control over other various parts of the index tab. In one embodiment, the aligning portion is operatively connected to both sides of the index tab, such that the user does not have to separate two sides of the index tab. The two sides are separated by the width of the aligning portion, and are both attached to the aligning portion such that the user need not make any adjustments during application of the index tab to ensure that the aligning portion actually engages the edge of the indexing material. The aligning portion also includes an adhesive portion for engaging the indexing material. The index tab of the present invention is designed for easy positioning along the indexing material by either covering the adhesive until the tab is positioned, or by selective placement of the adhesive so that the tab can be freely positioned or slid along the card or divider edge even with the adhesive exposed.

The index tab may comprise a single tab material layer having a tab portion and a tab extension. The tab material layer may be constructed of any suitable tab material, such as card stock or various plastic materials. The tab extension has a layer of adhesive applied thereto. The adhesive may be any appropriate adhesive such as, for example, glue, permanent tacky adhesive, or heat fusing. The adhesive layer has a pocket attached to it. The pocket comprises a pocket extension, a top edge stopper, and a pocket hinge. These three portions of the pocket are preferably formed by folding a single piece of material over itself. The internal surface of the pocket extension has a layer of adhesive disposed thereon. The adhesive layer is disposed such that a small gap remains between the top edge of the adhesive layer and the inside top edge of the stopper. The gap may be included in all embodiments of the present invention and may be, for example, 1/16 inch to 1/8 inch from the inside top edge of the stopper. The gap, in this embodiment and others, allows the tab construction to slide along a mounting sheet edge without being hindered by adhesive. Likewise, the internal surface of the pocket hinge may have a layer of adhesive applied along its lower edge portion. This leaves a gap between the top edge of the adhesive layer and the inside top edge of stopper, allowing the tab construction to slide freely along an indexing material edge. These two layers of adhesive will secure the tab to indexing material when it is attached. A releasable backing is applied to the adhesive layer to preserve the adhesive and prevent layers from adhering to each other prior to attachment of the tab to an indexing material. The releasable backing may be applied and folded over such that it also contacts and protects the adhesive layer. Thus, an index tab of the present invention has an integral stopper or pocket for engaging the edge of an indexing material such that alignment is easy and requires little user control over the position and movement of various parts of the index tab during the application process.

FIG. 28 is a cross-sectional view of an exemplary index tab 101 constructed according to the present invention. The exemplary tab comprises a single tab material layer 100 having a tab portion 102 and a tab extension 104. Tab material layer 100 may be constructed of any suitable tab material, such as card stock or various plastic materials. Tab extension 104 has a layer of adhesive 106 applied thereto. The adhesive may be any appropriate adhesive such as, for example, glue, permanent tacky adhesive, or heat fusing. Adhesive layer 106 has a pocket 108 attached to it. Pocket 108 comprises a pocket extension 110, a top edge stopper 112, and a pocket hinge 114. These three portions of pocket 108 are preferably formed by folding a single piece of material over itself. The internal surface of pocket extension 110 has a layer of adhesive 116 disposed thereon. Adhesive layer 116 is disposed such that a small gap 117 remains between the top edge of adhesive layer 116 and the inside top edge of stopper 112. Gap 117 may be included in all embodiments of the present invention and may be, for example, 1/16" to 1/8" from the inside top edge of stopper 112. Gap 117, in this embodiment and others, allows the tab construction 100 to slide along a mounting sheet edge without being hindered by adhesive. Likewise, the internal surface of pocket hinge 114 may have a layer of adhesive 118 applied along its lower edge portion. This leaves a gap 119 between the top edge of adhesive layer 118 and the inside top edge of stopper 112, allowing the tab construction 100 to slide freely along a mounting sheet edge. These two layers of adhesive will secure the tab to a mounting sheet when it is attached. A releasable backing 120 is applied to adhesive layer 116 to preserve the adhesive and prevent layers 116 and 118 from adhering to each other prior to attachment of the tab to a mounting sheet. Releasable backing 120 may be applied to layer 116 and folded over such that it also contacts and protects adhesive layer 118. Thus, an index tab of this invention has an integral stopper or pocket for engaging the edge of a mounting sheet such that alignment is easy and requires little user control over the position and movement of various parts of the index tab during the application process.

The index tab construction described above can be easily aligned with and attached to an edge of a mounting sheet, such as a binder divider sheet, as illustrated in the cross-sectional view of FIG. 29. Stopper 112 engages a top edge of divider sheet 200, indicated at 202. After releasable backing 120 is removed, mounting sheet 200 is secured to the tab between adhesive layers 116 and, optionally, 118.

An alternative second embodiment 301 of the present invention is illustrated in the cross-sectional view of FIG. 30. The tab comprises a tab portion 300, a tab extension 302 and a tab hinge 304. Tab extension 302 and tab hinge 304 are separated from tab portion 300 by a stopper 306. Stopper 306, in the exemplary embodiment, comprises a heat fuse which joins the two sides of tab portion 300. An internal surface of tab extension 302 is coated with an adhesive layer 308, which is then covered by a releasable backing 310. Another feature of the present invention is that releasable backing 310 may be folded at area 312, to form an easily grippable tab 314 that is useful for exposing adhesive layer 308 during application of the tab construction to a mounting sheet. Easily grippable tab 314, in all embodiments, facilitates removal of releasable backing 310. An additional feature that can be incorporated into the second exemplary embodiment is a second layer of adhesive on the inside surface of hinge 304. This second layer of adhesive would cause the attachment of the tab construction to a mounting sheet to be strengthened. Prior to mounting, the second layer of adhesive would be contacted and protected by releasable backing 310.

The second exemplary embodiment 301 of the present invention as it is applied to a mounting sheet 400 is depicted in FIG. 31. Lower edge 402 of heat fuse 306 is aligned with upper edge of mounting sheet 400 prior to application. Then, releasable backing 310 is pulled downward, as indicated at arrow 404, to expose adhesive layer 308. Tab extension 302 and hinge 304 are then pressed together to engage adhesive layer 308 with divider sheet 400, securing the tab in place.

Figure 32:
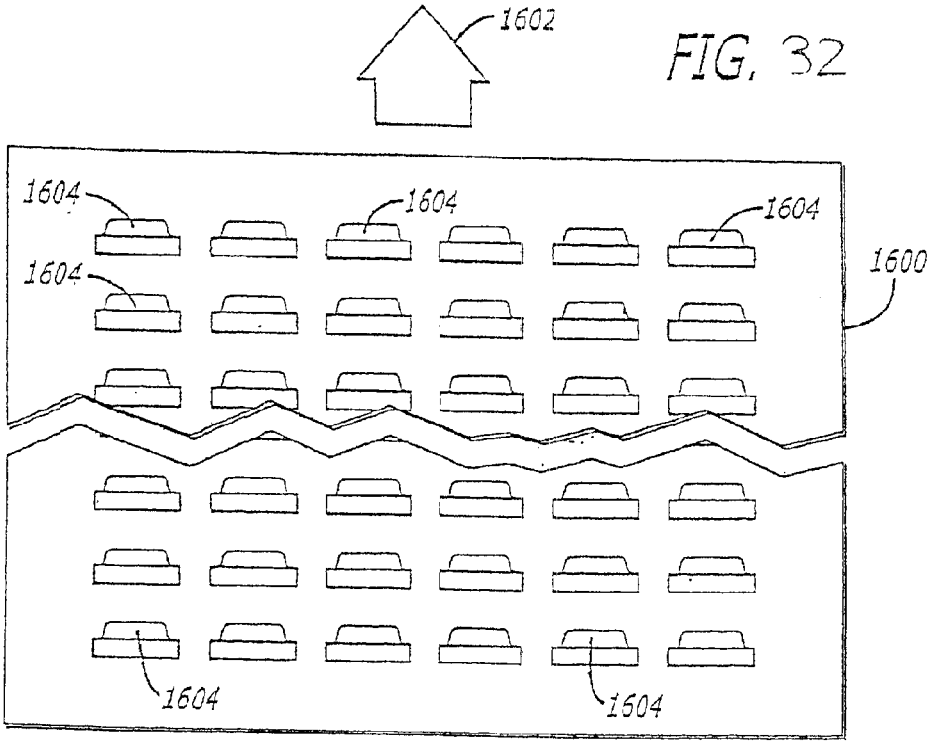
FIG. 32 illustrates a full sheet of multiple tabs according to the present invention, the sheet being capable of passing through a printing machine for printing thereon.
Figure 33:
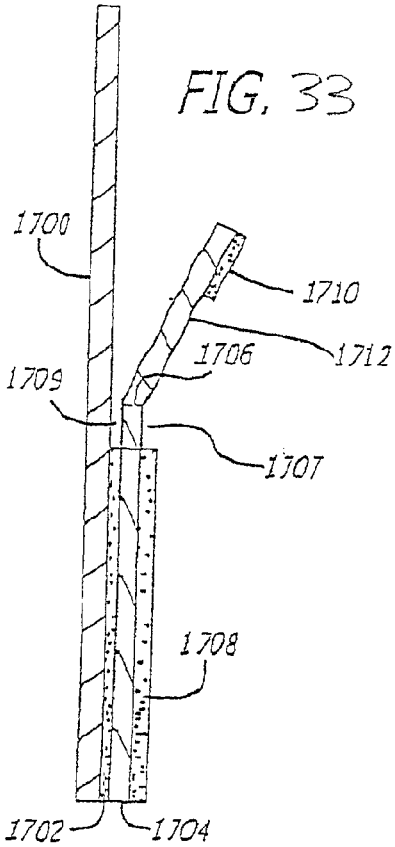
FIG. 33 is a cross-sectional view illustrating an exemplary tab area of the full sheet illustrated in FIG. 32.

Some of the various exemplary embodiments of the present invention can be practiced such that multiple tabs are constructed within a single sheet 1600, as indicated in FIG. 32. This sheet 1600 can be passed through a printer as indicated by arrow 1602 such that the tab areas 1604 can have indicia printed thereon. To describe the construction of such a sheet, the construction of a single tab area therein is illustrated in FIG. 33. The tab area comprises a first layer of tab material 1700 suitable for being passed through a printer, such as thin polyester or flexible card stock. An adhesive layer 1702 is then applied to a lower portion of tab material layer 1700. A pocket material layer 1704 is applied to and extends beyond adhesive layer 1702. A pocket pre-fold 1706 is formed along the upper edge of adhesive layer 1708. Pocket pre-fold 1706 may be, for example, a score line. Another layer of adhesive 1708 is then applied to the portion of pocket material layer 1704, below pocket pre-fold 1706. A region 1707 having no adhesive remains below pocket pre-fold 1706. Adhesive-free regions 1707 may be, for example, between 1/16" and 1/8", as measured between top edge of adhesive layer 1708 and pocket pre-fold 1706. Similarly, adhesive-free region 1709 may be, for example, between 1/16" and 1/8", as measured from top edge of adhesive layer 1702 to pocket pre-fold 1706. Alternatively, adhesive layer 1702 may extend substantially to pocket pre-fold 1706, resulting in no adhesive-free region 1709. An additional strip of adhesive 1710 is applied to the upper edge of pocket material layer 1704, above pocket pre-fold 1706. Again, adhesive 1710 is applied such that a region 1712, having no adhesive thereon, is located above pocket pre-fold 1706.

Figure 34:
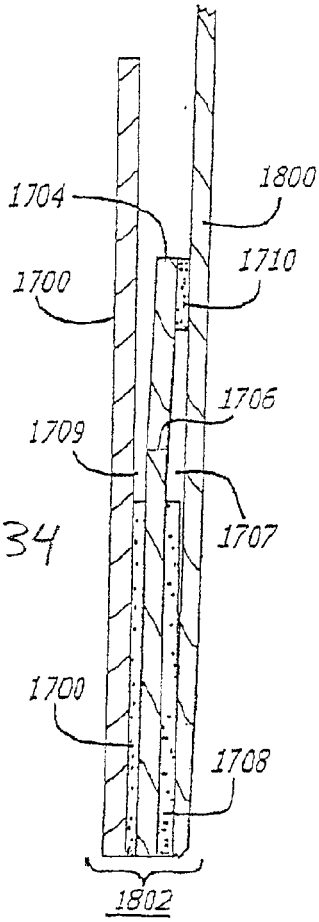
FIG. 34 is a cross-sectional view illustrating the exemplary tab area of FIG. 33 having a releasable backing applied thereto.

Finally, as indicated in FIG. 34, a releasable backing sheet 1800 is applied to the entire tab area construction, being adhered to adhesive layer 1708 and adhesive strip 1710. This releasable backing sheet 1800 thereby becomes tab-bearing sheet 1600. The thickness 1802 of the sheet and tab areas must be sufficiently small that the sheet can pass through printers within their standard clearances without jamming. For example, an ideal thickness would be less than 15.0 mils. or, more preferably, less than 9.0 mils. In any case, the preferred thickness could be determined according to standard machining techniques and printing machine tolerances. Thickness 1802 is measured as the summation of the individual thicknesses of the various layers, and can be minimized through optimization of these layers. In addition, the tab-bearing sheet assembly must be further optimized to ensure that the adhesive and releasable backing bond strength is sufficient to keep the tabs adhered to the backing sheet as the entire sheet is passed through the printer, but weak enough that the tabs can be removed easily by a user, after printing. Also, the sheet must be flexible such that the tab-bearing sheet can be passed through the printer rollers without becoming jammed therein.

Figure 35:
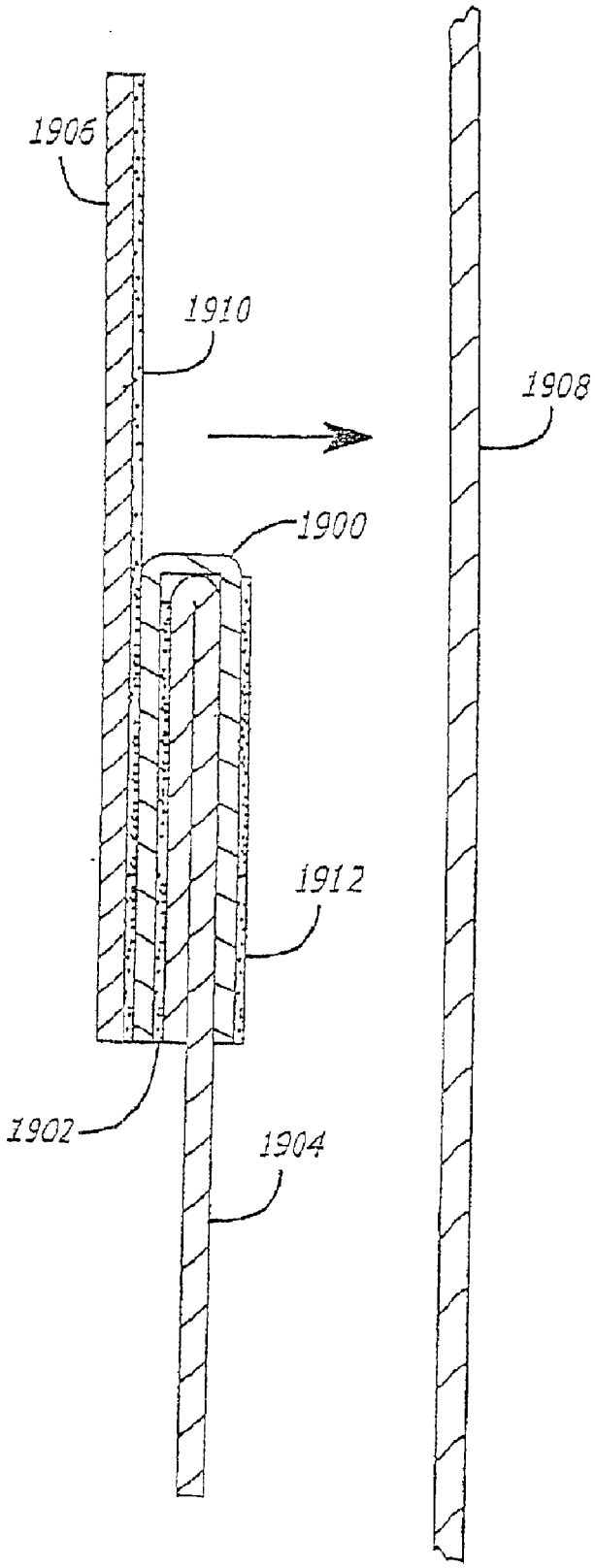
FIG. 35 is a cross-sectional view of an alternative exemplary layered tab area.

Although the design objectives of the tab-bearing sheet will be the same, other designs for the sheet are anticipated to be within the scope of the present invention. For example, FIG. 35 illustrates a pocket assembly comprising a folded over pocket layer 1900 having an adhesive layer 1902 and releasable backing layer 1904 therebetween and sandwiched between tab material layer 1906 and releasable backing sheet 1908. Adhesive layers 1910 and 1912 bind the pocket assembly between tab material layer 1906 and releasable backing sheet 1908. Each of these tabs can be removed from the tab-bearing sheet and aligned with and applied to a mounting sheet as previously described herein. It should be noted that in all index tab-bearing sheet embodiments described herein, manufacturing steps may occur in any order. That is, the layers of such a sheet, as described herein, are not necessarily the order in which the sheet must be constructed. Steps for constructing the index tab-bearing sheets may occur in any order.

Figure 36:
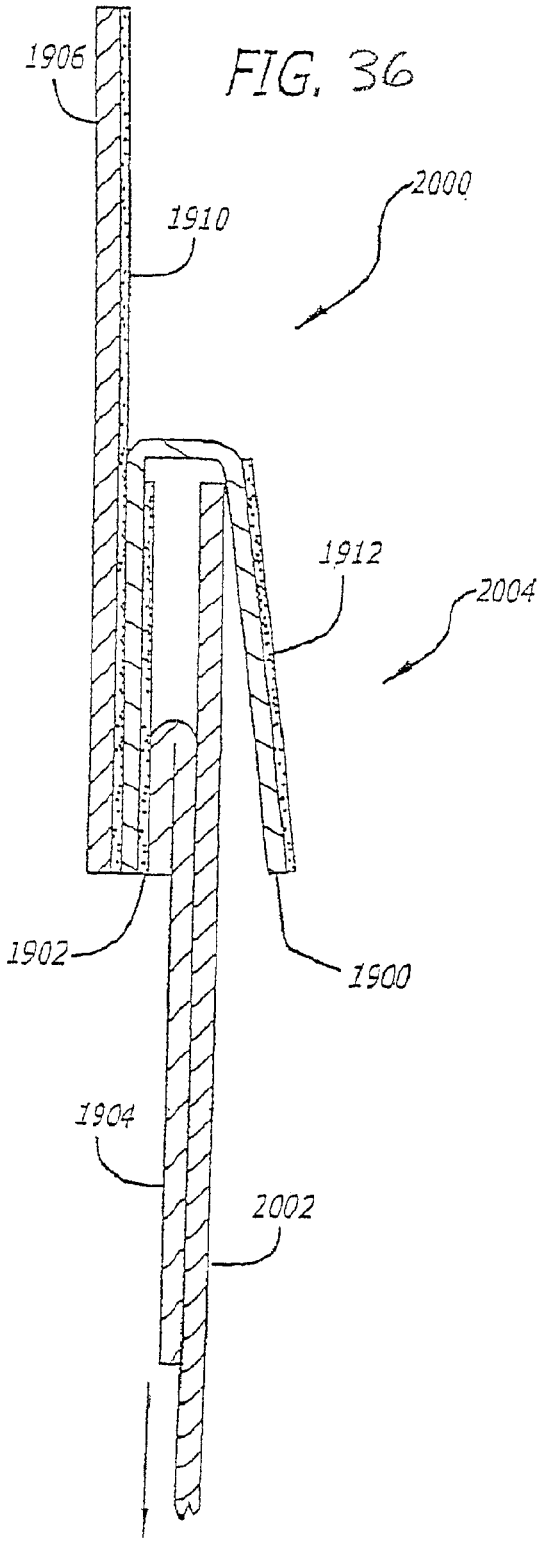
FIG. 36 illustrates use of the alternative exemplary layered tab area illustrated in FIG. 35.
Figure 37:
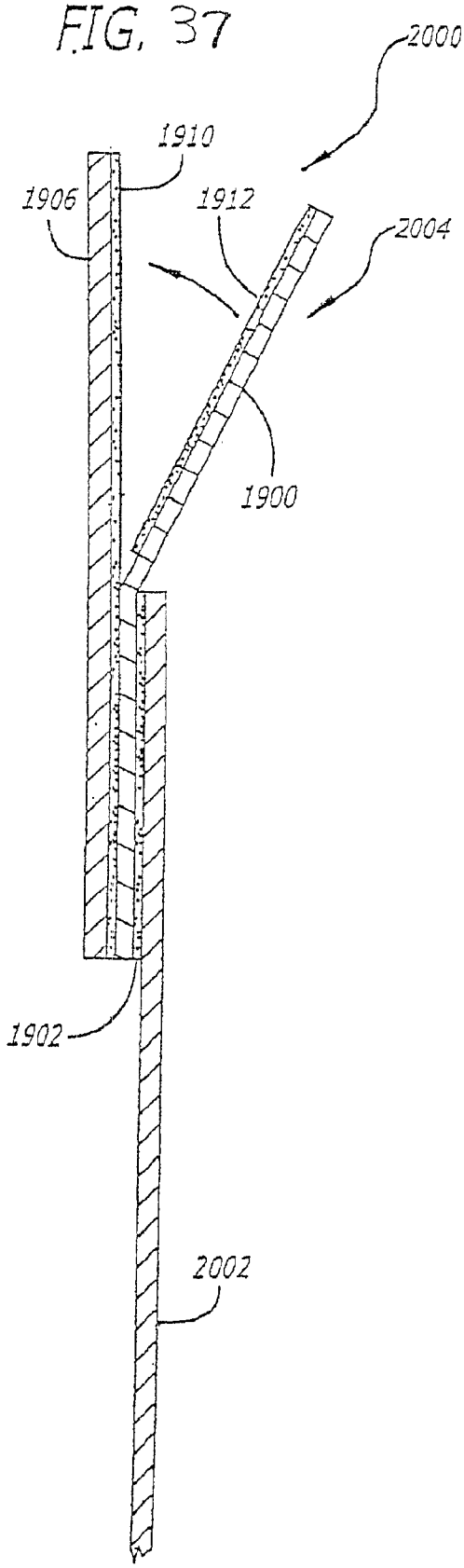
FIG. 37 illustrates use of the alternative exemplary layered tab area illustrated in FIG. 35.

FIGS. 36 and 37 illustrate how a tab 2000 from a tab-bearing sheet, tab 2000 constructed as in FIG. 35, would be utilized. A mounting sheet 2002 is inserted between releasable backing 1904 and outer side 2004 of pocket 1900, shown in FIG. 36. Releasable backing 1904 is then removed, and adhesive layer 1902 contacts mounting sheet 2002, securing the tab construction thereto. Referring to FIG. 37, once the tab construction is aligned with and secured to mounting sheet 2002, outer pocket side 2004 is folded upward, such that adhesive layer 1912 binds to adhesive layer 1910. This completes the tab assembly after it is mounted upon and aligned with mounting sheet 2002.

Another exemplary embodiment is shown at 2200 in FIG. 38, which illustrates an exemplary tab area 2200 contained in a tab-bearing sheet. A first layer of tab material 2202 has a first layer of adhesive 2204 applied thereon. A pocket assembly is then formed by providing a second layer of tab material 2206 and applying a second layer of adhesive 2208 thereon. The pocket is formed by creating fold 2210. Backing sheet 2212 is then applied, such that it contacts adhesive layers 2204 and 2208.

Once removed from backing sheet 2212, the tab construction above is used as illustrated in FIG. 39. Mounting sheet 2300 is adhered to adhesive layer 2204. The outer portion of the pocket is then folded downward, as indicated at fold line 2210 and arrow 2302. Adhesive layer 2208 will contact mounting sheet 2300, causing the tab assembly to be completely secured to the mounting sheet 2300.

As an alternative embodiment to the tab area described above and illustrated in FIGS. 38 and 39, adhesive layers 2208 and 2204 may comprise three separate adhesive layers. This alternative construction is illustrated in FIG. 40, which illustrates the tab assembly as generally shown in the region of fold line 2210. Specifically, a first adhesive layer 2400 may be disposed between the upper portion of tab material layer 2202 and the inner portion of pocket material layer 2206. A second adhesive layer 2404 is applied to the lower portion of tab material layer 2202. Finally, a third adhesive layer 2402 is applied to the inner portion of pocket material layer 2206. As indicated at region 2406, the three layers of adhesive are non-continuous. This serves both to facilitate the bending which occurs at fold line 2210 and to align the tab construction with mounting sheet 2300.

Many modifications and variations of the present invention are possible in light of the above teachings. For example, various arrangements and types of layers may be used to form the stopper or pocket of the present invention. Also, the present invention is not limited to use with paper or plastic tabs, as presented in the exemplary embodiments. Rather, the invention may be utilized with any of a number of different suitable materials. Moreover, different parts of the present invention may be practiced with the use of different materials. For example, a tab according to the present invention may be constructed to have a tab portion comprising a first material and a pocket or stopper comprising a second, different material. Also, the folding of the releasable backing strip to form an easily grippable tab can be applied to all embodiments having a releasable backing strip.

It is to be understood that other embodiments may be utilized and structural and functional changes may be made without departing from the scope of the present invention. The foregoing descriptions of embodiments of the invention have been presented for the purposes of illustration and description. It is not intended to be exhaustive or to limit the invention to the precise forms disclosed. Accordingly, many modifications and variations are possible in light of the above teachings. For example, a set of releasably attachable alignment tools may include specific indicia printed thereon for a specific number of index tabs. That is, if a set of releasably attachable alignment tools is provided with eight index tabs, the tool may be printed with indicia for directing the placement of eight index tabs instead of a high number of index tabs. It is therefore intended that the scope of the invention not be limited by this detailed description.

We claim:

1. An index tab alignment system, comprising:

a set of releasably attachable index tab alignment tools;

a set of indexing documents including a first indexing document and at least one additional indexing document, each document having a releasably attachable index tab alignment tool from the set of releasably attachable alignment tools releasably attached thereto at a distance from an edge of each document;

a set of index tabs having at least one index tab for application to the set of indexing documents, each releasably attachable index tab alignment tool in the set of releasably attachable alignment tools having indicia thereon for guiding the placement of said at least one index tab; and a package holding the set of indexing documents, the set of index tabs, and the set of releasably attachable index tab alignment tools.

2. The system of claim 1, wherein the set of releasably attachable alignment tools are stacked on top of each other within said package.

3. An assembly for affixation of index tabs to documents, said assembly comprising:

at least one alignment tool formed on a sheet, the at least one alignment tool being removable from the sheet to be releasably attachable to a document, wherein the at least one alignment tool is removable from the sheet along separation indicators; and indicia on the at least one alignment tool identifying index tab alignment positions.

4. The assembly of claim 3, wherein the at least one alignment tool is one of a plurality of alignment tools positioned on the sheet.

5. The assembly of claim 4, wherein the indicia includes a plurality of vertical lines and a plurality of horizontal lines dimensioned to align the placement of the desired number of index tabs with an edge of the document.

6. The assembly of claim 3, wherein the document is one of a set of indexing documents.

7. The assembly of claim 6, wherein the plurality of alignment tools includes a first alignment tool and a second alignment tool, the indicia on each of the first and second alignment tools configured for identifying index tab alignment positions on documents of different dimensions.

8. The assembly of claim 3, wherein the indicia includes a numbering system, the numbering system sequentially positioned on the alignment tools for application of a desired number of index tabs.

9. The assembly of claim 3, further comprising a set of instructions positioned on the sheet.

10. The assembly of claim 9, wherein the instructions are printed on the sheet.

11. The assembly of claim 3, wherein the plurality of alignment tools each include a foldable top portion at an upper end of the alignment tool, the foldable top portion for folding over the document at a top edge of the document to releasably attach the alignment tool to the document.

12. The assembly of claim 3, wherein the at least one alignment tool is releasably attachable to the document to align an index tab along an edge of the document, the tool being positioned on the document at a distance from the edge to allow placement of an index tab between the alignment tool and the edge.

13. The assembly of claim 12, wherein the document is a divider.

14. The assembly of claim 13, wherein the divider is capable of passing through a printer for printing directly on the divider.

15. The assembly of claim 12, wherein the document is an index card.

16. The assembly of claim 3, further comprising a plurality of index tabs, and the plurality of alignment tools being positionable on the set of documents to apply the plurality of index tabs to the set of documents.

17. The assembly of claim 16, further comprising a package configured to hold the at least one alignment tool positioned on the sheet, a plurality of index tabs, and a set of indexing documents on which the plurality of index tabs will be placed using the plurality of alignment tools.

18. A packaging assembly comprising:

a set of indexing documents;

at least one alignment tool positioned on a sheet, the at least one alignment tool removable from the sheet along separation lines and releasably positionable on the set of indexing documents; and;

a set of index tabs for application to the set of indexing documents, the at least one alignment tool having indicia thereon for guiding the placement of at least one index tab in the set of index tabs; and a package holding the set of indexing documents, the set of index tabs, and the sheet having the at least one alignment tool positioned thereon.

19. The assembly of claim 18, wherein the at least one alignment tool is one of a set of alignment tools positioned on the sheet.

20. The assembly of claim 19, wherein the indicia includes a numbering system, the numbering system sequentially positioned on each alignment tool in the set of alignment tools for application of a desired number of index tabs in the set of index tabs.

21. The assembly of claim 19, wherein the indicia includes a plurality of vertical lines and a plurality of horizontal lines dimensioned to align the placement of the desired number of index tabs with an edge of a document.

22. The assembly of claim 21, wherein the set of alignment tools includes a first alignment tool and a second alignment tool, the indicia on each of the first and second alignment tools configured for the placement of index tabs on documents of different dimensions in the set of documents.

23. The assembly of claim 18, further comprising a set of instructions positioned on the sheet.

24. The assembly of claim 23, wherein the set of instructions is printed on the sheet.

25. The assembly of claim 18, wherein each alignment tool in the set of alignment tools includes a foldable top portion at an upper end of the alignment tool, the foldable top portion for folding over a document in the set of indexing documents at a top edge of the document to releasably attach the alignment tool to the document.

26. The assembly of claim 18, wherein each alignment tool in the set of alignment tools is releasably attachable to an indexing document in the set of documents to align index tabs along edges of the indexing document, wherein the alignment tools are positioned on the indexing document at a distance from the edges to allow placement of index tabs between the alignment tool and the edge.

27. The assembly of claim 26, wherein the set of documents includes dividers.

28. The assembly of claim 27, wherein the dividers are capable of passing through a printer for printing directly on the dividers.

29. The assembly of claim 26, wherein the set of documents includes index cards.

30. The assembly of claim 18, wherein each index tab in the set of index tabs includes a tab portion and a pocket attached to a lower edge of the tab portion, the pocket including a top edge, a hinge portion and a pocket extension portion, wherein the pocket receives and is attached to an indexing document in the set of indexing documents, a top edge of the indexing document aligned with the top edge of the pocket, and wherein said hinge portion and said pocket extension portion are operatively connected by said top edge.

31. The assembly of claim 30, wherein said pocket further comprises a first layer of adhesive on an inner surface of the pocket extension portion and a second layer of adhesive on an inner surface of the hinge portion, the second layer of adhesive protected by a releasable backing, the releasable backing extending downward below each index tab to facilitate removal.

32. The assembly of claim 31, wherein the releasable backing is folded to form an easily grippable tab.

33. The assembly of claim 18, wherein each index tab in the set of index tabs includes a tab portion having a first side and a second side, a hinge, and a tab extension, the hinge and the tab extension being separated from the tab portion by a stopper, the stopper formed along a lower edge of said tab portion.

34. The assembly of claim 33, wherein the stopper comprises a heat fuse, said heat fuse connecting inner surfaces of said first side and said second side of said tab portion, a first adhesive layer on an inside surface of said tab extension, and a releasable backing applied to said first adhesive layer, the releasable backing extending downward below said index tab to facilitate removal.

35. The assembly of claim 34, wherein the releasable backing is folded to form an easily grippable tab.

36. The assembly of claim 18, wherein the set of index tabs is disposed on an index tab-bearing sheet capable of being passed through a printer or copier, the index tab-bearing sheet having a plurality of tab areas defined thereon, each of said tab areas comprising:

a first layer of tab material;

a second layer of adhesive applied to a lower portion of said first layer of tab material;

a third layer of pocket material applied to said second layer of adhesive and having a pocket pre-fold aligned with an upper edge of said second layer of adhesive;

a lower fourth layer of adhesive applied to said third layer of pocket material below said pocket pre-fold line;

an upper fourth layer of adhesive applied to an upper edge portion of said third layer of pocket material; and a releasable backing sheet applied to said fourth layer of adhesive;

whereby the index tab-bearing sheet can be passed through a printer or copier for a printing operation on the tab areas.

37. A method of applying index tabs to documents, comprising:

providing a plurality of alignment tools on a sheet, a plurality of indicia printed on each of the alignment tools, a plurality of index tabs, and a set of indexing documents;

separating at least one of the plurality of alignment tools from the sheet;

positioning the at least one removed alignment tool from the sheet on a document in the set of indexing documents;

aligning at least one of the plurality of index tabs along an edge of the document, the plurality of indicia guiding the placement of the at least one index tab on the document; and removing the at least one alignment tool from the document.

38. The method of claim 37, further comprising providing separation indicators on the sheet, the plurality of alignment tools being removable from sheet along the separation lines and releasably positionable on documents in the set of indexing documents.

39. The method of claim 37, wherein the indicia includes a numbering system, the numbering system sequentially positioned on the alignment tools for application of a desired number of index tabs.

40. The method of claim 39, wherein the indicia includes a plurality of vertical lines and a plurality of horizontal lines dimensioned to align the placement of the desired number of index tabs with an edge of a document.

41. The method of claim 40, wherein the plurality of alignment tools includes a first alignment tool and a second alignment tool, the indicia on each of first and second alignment tools configured for identifying index tab alignment positions on documents of different dimensions.

42. The method of claim 37, further comprising a set of instructions positioned on the sheet.

43. The method of claim 42, wherein the set of instructions is printed on the sheet.

44. The method of claim 37, wherein the plurality of alignment tools each include a foldable top portion at an upper end of the alignment tool, the foldable top portion for folding over a document at a top edge of the document to releasably attach the alignment tool to the document.

45. The method of claim 37, wherein the set of indexing documents includes dividers.

46. The method of claim 45, wherein the dividers are capable of passing through a printer for printing directly on the dividers.

47. The method of claim 37, wherein the set of documents includes index cards.

48. The method of claim 37, further comprising packaging the plurality of alignment tools, the plurality of index tabs, and the set of indexing documents in a package.

49. A method of applying index tabs to indexing material, comprising:

providing an indexing document, a releasably attachable alignment tool attached to said indexing document, and an index tab;

aligning the index tab along an edge of said indexing document, the tool including a plurality of indicia printed thereon for guiding the placement of the index tab; and removing the releasably attachable alignment tool from the indexing document.

50. The method of claim 49, further comprising applying at least one additional releasably attachable alignment tool to at least one additional indexing document.

51. The method of claim 50, further comprising removing the at least one additional releasably attachable alignment tool from the at least one additional indexing document.

52. The method of claim 50, further comprising aligning at least one additional index tab along an edge of the at least one additional indexing document, the plurality of indicia guiding the placement of the at least one additional index tab on the at least one additional indexing document.

53. The method of claim 52, further comprising packaging the indexing document and at least one additional indexing document, the index tab and at least one additional index tab, and the releasably attachable alignment tool and at least one additional releasably attachable index tab alignment tool in a package.

54. The method of claim 50, wherein each of said releasably attachable alignment tools and at least one additional releasably attachable alignment tool are positioned on an indexing document to align at least one additional index tab along an edge of the indexing document, each tool being positioned on the indexing document at a distance from said edge to allow placement of an index tab between said tool and said edge.

55. The method of claim 50, wherein the indexing document and the at least one additional indexing document comprise a set of dividers.

56. The method of claim 55, wherein the indexing document and the at least one additional indexing document comprise a set of index cards.

57. The method of claim 50, further comprising color coding each of said releasably attachable alignment tool and at least one additional releasably attachable alignment tool, each tool being color coded to correspond to a different placement for a desired number of index tabs.

58. The method of claim 49, further comprising printing said plurality of indicia on said releasably attachable alignment tool using a printer.

59. The method of claim 49, further comprising providing a device having an opening on at least one side, said alignment tool being releasably attached to a side of said device.

60. The method of claim 49, providing a device having an opening on at least one side, said releasably attachable alignment tool including a top portion folded at an upper end of the releasably attachable alignment tool, said top portion being folded over said device at a top edge of said device to releasably attach the releasably attachable alignment tool to the device.

61. The method of claim 49, further comprising providing a sheet having a plurality of releasably alignment tools positioned thereon, said plurality of releasably attachable alignment tools being printable on said sheet by a printer.

62. The method of claim 49, further comprising providing a sheet having a plurality of releasably alignment tools positioned thereon, said plurality of releasably attachable alignment tools being surrounded by a plurality of weakened lines for punching said plurality of releasably attachable alignment tools out from said sheet.

63. The method of claim 49, wherein said tool includes a top portion folded at an upper end of the tool, said top portion being folded over said document at a top edge of said document to releasably attach the tool to the document.

64. The method of claim 49, further comprising downloading a computer program from a network, the program being configured to print said indicia on said releasably attachable alignment tool.

65. A method of affixation of index tabs to documents, said method comprising:

providing a releasably attachable alignment tool having indicia thereon identifying multiple index tab alignment positions, the alignment tool being releasably attachable to a first indexing document;

applying a first index tab to the first indexing document, the alignment tool guiding the placement of said index tab along said edge of said first indexing document; and removing the releasably attachable alignment tool from said first document.

66. The method of claim 65, further comprising removing a backing material from said releasably attachable alignment tool and applying said tool to said indexing document.

67. The method of claim 65, further comprising applying a plurality of releasably attachable alignment tools to a plurality of indexing documents, the indexing documents being a set of dividers, each tool being releasably attachable to one divider.

68. The method of claim 65, further comprising applying a plurality of releasably attachable alignment tools to a plurality of indexing documents, the indexing documents being a set of index cards, each tool being releasably attachable to one of the index cards of the set.

69. The method of claim 65, further comprising aligning a plurality of index tabs along edges of the plurality of indexing documents, each indexing document having at least one index tab aligned along an edge, the plurality of indicia guiding the placement of the index tabs on the indexing documents.

70. The method of claim 69, further comprising packaging the plurality of indexing documents, the plurality of index tabs, and the plurality of releasably attachable index tab alignment tools in a package.

71. The method of claim 69, wherein the releasably attachable alignment tool is releasably attachable to each indexing document along an edge of each indexing document, each tool being positioned on each indexing document at a distance from said edge to allow placement of an index tab between said tool and said edge.

72. The method of claim 71, further comprising color coding each of said releasably attachable alignment tools, each tool being color coded to correspond to a different placement for a desired number of index tabs.

73. The method of claim 65, further comprising providing a plurality of index tabs each including a tab portion and a pocket attached to a lower edge of the tab portion, the pocket including a top edge, a hinge portion and a pocket extension portion, wherein the pocket receives and is attached to an indexing document, a top edge of the indexing document aligned with the top edge of the pocket, and wherein said hinge portion and said pocket extension portion are operatively connected by said top edge.

74. The method of claim 73, wherein said pocket further comprises a first layer of adhesive on an inner surface of the pocket extension portion and a second layer of adhesive on an inner surface of the hinge portion, the second layer of adhesive protected by a releasable backing, the releasable backing extending downward below each index tab to facilitate removal.

75. The method of claim 74, wherein the releasable backing is folded to form an easily grippable tab.

76. The method of claim 65, further comprising providing a plurality of index tabs each including a tab portion having a first side and a second side, a hinge, and a tab extension, the hinge and the tab extension being separated from the tab portion by a stopper, the stopper formed along a lower edge of said tab portion.

77. The method of claim 76, wherein the stopper comprises a heat fuse, said heat fuse connecting inner surfaces of said first side and said second side of said tab portion, a first adhesive layer on an inside surface of said tab extension, and a releasable backing applied to said first adhesive layer, the releasable backing extending downward below said index tab to facilitate removal.

78. The method of claim 77, wherein said releasable backing is folded to form an easily grippable tab.

79. The method of claim 65, further comprising providing a plurality of index tabs positioned on an index tab-bearing sheet capable of being passed through a printer or copier, the index tab-bearing sheet having a plurality of tab areas defined thereon, each of said tab areas comprising:

a first layer of tab material;

a second layer of adhesive applied to a lower portion of said first layer of tab material;

a third layer of pocket material applied to said second layer of adhesive and having a pocket pre-fold aligned with an upper edge of said second layer of adhesive;

a lower fourth layer of adhesive applied to said third layer of pocket material below said pocket pre-fold line;

an upper fourth layer of adhesive applied to an upper edge portion of said third layer of pocket material; and a releasable backing sheet applied to said fourth layer of adhesive, whereby said index tab-bearing sheet can be passed through a printer or copier for a printing operation on the tab areas.

80. The method of claim 65, further comprising printing said plurality of indicia on said releasably attachable alignment tool using a printer.

81. The method of claim 65, further comprising providing a device having an opening on at least one side, said alignment tool being releasably attached to a side of said device.

82. The method of claim 65, providing a device having an opening on at least one side, said releasably attachable alignment tool including a top portion folded at an upper end of the releasably attachable alignment tool, said top portion being folded over said device at a top edge of said device to releasably attach the releasably attachable alignment tool to the device.

83. The method of claim 65, further comprising providing a sheet having a plurality of releasably alignment tools positioned thereon, said plurality of releasably attachable alignment tools being printable on said sheet by a printer.

84. The method of claim 65, further comprising providing a sheet having a plurality of releasably alignment tools positioned thereon, said plurality of releasably attachable alignment tools being surrounded by a plurality of weakened lines for punching said plurality of releasably attachable alignment tools out from said sheet.

85. The method of claim 65, wherein said tool includes a top portion folded at an upper end of the tool, said top portion being folded over said document at a top edge of said document to releasably attach the tool to the document.

86. The method of claim 65, further comprising downloading a computer program from a network, the program being configured to print said indicia on said releasably attachable alignment tool.

87. An assembly for precise affixation of index tabs to documents, said assembly comprising:

a releasably attachable alignment tool;

indicia on said tool identifying multiple index tab alignment positions;

a plurality of index tabs and a plurality of releasably attachable alignment tools, the plurality of tools being applied to a set of dividers to apply said plurality of index tabs to said set of dividers; and a package configured to hold the plurality of index tabs and the set of dividers, each divider having an alignment tool releasably attached thereto.

88. An assembly for precise affixation of index tabs to documents, said assembly comprising:

a releasably attachable alignment tool;

indicia on said tool identifying multiple index tab alignment positions;

wherein said plurality of indicia is printed on said releasably attachable alignment tool using a printer;

wherein a plurality of releasably attachable alignment tools are positioned on a sheet, said plurality of indicia being printed on each tool on said sheet using said printer as desired by a user; and wherein said plurality of releasably attachable alignment tools are surrounded by a plurality of weakened lines for punching said plurality of releasably attachable alignment tools out from said sheet.

89. An assembly for precise affixation of index tabs to documents, said assembly comprising:

a releasably attachable alignment tool;

indicia on said tool identifying multiple index tab alignment positions;

a plurality of index tabs each including a tab portion and a pocket attached to a lower edge of the tab portion, the pocket including a top edge, a hinge portion and a pocket extension portion, wherein the pocket receives and is attached to a document, a top edge of the document aligned with the top edge of the pocket, and wherein said hinge portion and said pocket extension portion are operatively connected by said top edge; and wherein said pocket further comprises a first layer of adhesive on an inner surface of the pocket extension portion and a second layer of adhesive on an inner surface of the hinge portion, the second layer of adhesive protected by a releasable backing, the releasable backing extending downward below each index tab to facilitate removal.

90. The assembly of claim 89, wherein the releasable backing is folded to form an easily grippable tab.

91. An assembly for precise affixation of index tabs to documents, said assembly comprising:

a releasably attachable alignment tool;

indicia on said tool identifying multiple index tab alignment positions;

a plurality of index tabs each including a tab portion having a first side and a second side, a hinge, and a tab extension, the hinge and the tab extension being separated from the tab portion by a stopper, the stopper formed along a lower edge of said tab portion;

wherein the stopper comprises a heat fuse, said heat fuse connecting inner surfaces of said first side and said second side of said tab portion, a first adhesive layer on an inside surface of said tab extension, and a releasable backing applied to said first adhesive layer, the releasable backing extending downward below said index tab to facilitate removal; and wherein said releasable backing is folded to form an easily grippable tab.

92. An assembly for precise affixation of index tabs to documents, said assembly comprising:

a releasably attachable alignment tool;

indicia on said tool identifying multiple index tab alignment positions; and a plurality of index tabs positioned on an index tab-bearing sheet capable of being passed through a printer or copier, the index tab-bearing sheet having a plurality of tab areas defined thereon, each of said tab areas comprising:

a first layer of tab material;

a second layer of adhesive applied to a lower portion of said first layer of tab material;

a third layer of pocket material applied to said second layer of adhesive and having a pocket pre-fold aligned with an upper edge of said second layer of adhesive;

a lower fourth layer of adhesive applied to said third layer of pocket material below said pocket pre-fold line;

an upper fourth layer of adhesive applied to an upper edge portion of said third layer of pocket material;

a releasable backing sheet applied to said fourth layer of adhesive; and whereby the index tab-bearing sheet can be passed through a printer or copier for a printing operation on the tab areas.

93. A customizable indexing system, comprising:

at least one releasably attachable alignment tool;

a plurality of indicia disposed on said at least one alignment tool;

an indexing material, the at least one alignment tool being releasably attachable to said indexing material;

wherein the plurality of indicia is printed on the releasably attachable alignment tool using a printer;

wherein a plurality of releasably attachable alignment tools are positioned on a sheet, the plurality of indicia being printed on each tool on the sheet using the printer as desired by a user; and wherein the plurality of releasably attachable alignment tools are surrounded by a plurality of weakened lines for punching the plurality of releasably attachable alignment tools out from the sheet.

94. An index tab affixation assembly, comprising:

a sheet having a plurality of index divider alignment tools positioned thereon and removable therefrom, each of said tools having thereon indicia means for identifying different index tab affixation positions at different positions along edges of documents when said tools are positioned on the documents, wherein said sheet includes weakened separation lines defining at least portions of perimeters of said tools.

95. The assembly of claim 94, wherein said indicia means includes indicia printed on said tools.

96. An index tab affixation assembly, comprising:

a sheet having a plurality of index divider alignment tools positioned thereon and removable therefrom, each of said tools having thereon indicia means for identifying different index tab affixation positions at different positions along edges of documents when said tools are positioned on the documents, wherein said indicia means includes a first set of indicia on one of said tools denoting a first set of spaced index tab affixation positions for a first set of indexing documents and a second set of indicia on the one of said tools denoting a second set of spaced index tab affixation positions, different than said first set of spaced index tab affixation positions, for a second set of indexing documents having a different number of documents than said first set.

97. The assembly of claim 96, wherein the first set of indicia includes a plurality of first symbols and the second set of indicia includes a plurality of second symbols different than the first symbols.

98. The assembly of claim 96, wherein the first set of indicia includes a plurality of lines of a first length and the second set of indicia includes a plurality of lines of a different second length and parallel to the plurality of lines of the first length.

99. The assembly of claim 96, wherein the first set of indicia includes a first color and the second set of indicia includes a different second color.

100. An index tab alignment assembly, comprising:

an indexing sheet having a first side and an opposite second side and a first edge and an opposite second edge; and indicia means on the second side adjacent the second edge for identifying different index tab affixation positions at different positions along the first edge when the second edge is positioned on the first side adjacent to the first edge.

101. An index tab alignment assembly, comprising:

an alignment tool;

positioning means for releasably positioning said tool on each document of a set of indexing documents;

indicia means on said tool for identifying different index tab affixation positions at different positions along edges of each of the documents of said set when said tool is positioned thereon by said positioning means;

wherein said set of indexing documents defines a first set of indexing documents, and said positioning means releasably positions said tool on each document of a second set of indexing documents having a different number of documents than said first set of documents, and said indicia means includes a first set of indicia on said tool denoting a first set of spaced index tab affixation positions for said first set of documents and a different second set of indicia on said tool denoting a different second set of spaced index tab affixation positions for said second set of documents;

wherein said first set of indicia includes a plurality of first symbols and said second set of indicia includes a plurality of second symbols different than said first symbols; and wherein said first symbols are the number of documents in said first set of documents and said second symbols are the number of documents in said second set.

102. An index tab alignment assembly, comprising:

an alignment tool;

positioning means for releasably positioning said tool on each document of a set of indexing documents;

indicia means on said tool for identifying different index tab affixation positions at different positions along edges of each of the documents of said set when said tool is positioned thereon by said positioning means;

wherein said set of indexing documents defines a first set of indexing documents, and said positioning means releasably positions said tool on each document of a second set of indexing documents having a different number of documents than said first set of documents, and said indicia means includes a first set of indicia on said tool denoting a first set of spaced index tab affixation positions for said first set of documents and a different second set of indicia on said tool denoting a different second set of spaced index tab affixation positions for said second set of documents; and wherein said first set of indicia include a first color and said second set of indicia include a second color.

103. An index tab alignment assembly, comprising:

an alignment tool;

indicia means on said tool for identifying different index tab affixation positions at different positions along edges of each of the documents of a first set of indexing documents when said tool is positioned thereon and for identifying different index tab affixation positions at different positions along edges of the documents of a second set of indexing documents when said tool is positioned thereon, said indicia means includes a first set of indicia on said tool denoting a first set of spaced index tab affixation positions for said first set of documents and a different second set of indicia on said tool denoting a different second set of spaced index tab affixation positions for said second set of documents;

wherein said first set of indicia includes a plurality of first symbols and said second set of indicia includes a plurality of second symbols different than said first symbols; and wherein said first symbols are the number of documents in said first set of documents and said second symbols are the number of documents in said second set.

104. An index tab alignment assembly, comprising:

an alignment tool;

indicia means on said tool for identifying different index tab affixation positions at different positions along edges of each of the documents of a first set of indexing documents when said tool is positioned thereon and for identifying different index tab affixation positions at different positions along edges of the documents of a second set of indexing documents when said tool is positioned thereon, said indicia means includes a first set of indicia on said tool denoting a first set of spaced index tab affixation positions for said first set of documents and a different second set of indicia on said tool denoting a different second set of spaced index tab affixation positions for said second set of documents; and wherein said first set of indicia includes a first color and said second set of indicia includes a different second color.

* * * * *